US006206007B1

(12) United States Patent
Yoshida et al.

(10) Patent No.: US 6,206,007 B1
(45) Date of Patent: Mar. 27, 2001

(54) CIGARETTE WITH A DUAL-STRUCTURE FILTER

(75) Inventors: Takaichi Yoshida; Hayato Hasebe; Kazuyo Kaneki, all of Yokohama; Shinichiro Tanaka, Tokyo, all of (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 09/095,132

(22) Filed: Jun. 10, 1998

(30) Foreign Application Priority Data

Jun. 16, 1997 (JP) ..... 9-158684
Jun. 16, 1997 (JP) ..... 9-158747

(51) Int. Cl.[7] ..... A24D 3/04

(52) U.S. Cl. ..... 131/344; 131/331; 131/336; 131/340; 131/341; 131/345

(58) Field of Search ..... 131/341, 344, 131/336, 331, 339, 340, 200, 202

(56) References Cited

U.S. PATENT DOCUMENTS 5,360,023 * 11/1994 Blakely ..... 131/331
5,549,125 * 8/1996 White ..... 131/342
5,839,449 * 11/1998 Banerjee et al. ..... 131/342

* cited by examiner

*Primary Examiner*—James Derrington
(74) *Attorney, Agent, or Firm*—Birch, Stewart, Kolasch & Birch, LLP

(57) ABSTRACT

A cigarette with a dual-structure filter includes a dual-structure filter having a first filter element and a second filter element arranged downstream of the first filter element, a tobacco rod arranged upstream of the filter, and a tip paper covering a downstream end portion of the tobacco rod and a circumferential surface of the filter. At least one row of a plurality of holes are formed in the tip paper in a circumferential direction of the filter. An air-permeation resistance per unit length of the second filter element is at least twice that of the first filter element. An air inflow rate from the tip paper is at least 20%.

25 Claims, 25 Drawing Sheets

FAPR(CLOSED)=100mm H2O

FAPR(OPEN)=87.5mm H2O

FAPR(OPEN)=93.75mm H2O

FAPR (CLOSED) =100mmH2O
Vf=70 (%)

FAPR (CLOSED) =100mmH2O
Vf=70 (%)

FAPR (CLOSED) =65mmH2O
Vf=30 (%)

FAPR (CLOSED) =65mmH2O
Vf=30 (%)

FAPR (CLOSED) =100mmH2O
PD RATIO=6

FAPR (CLOSED) =65mmH2O
PD RATIO=1.5

FAPR (CLOSED) =85mmH2O
PD RATIO=1.5

FAPR (CLOSED) =100mmH2O
PD RATIO=1.5

FAPR (CLOSED) =70mmH2O
PD RATIO=3

FAPR (CLOSED) =80mmH2O
PD RATIO=3

FAPR (CLOSED) =90mmH2O
PD RATIO=3

FAPR (CLOSED) =100mmH2O
PD RATIO=3

FAPR (CLOSED) =120mmH2O
PD RATIO=3

FAPR (CLOSED) =70mmH2O
PD RATIO=10

FAPR (CLOSED) =85mmH2O
PD RATIO=10

FAPR (CLOSED) =100mmH2O
PD RATIO=10

Vf=40%
PD RATIO=6

Vf=70%
PD RATIO=6

Vf=55%
PD RATIO=1.5

Vf=70%
PD RATIO=1.5

Vf=85%
PD RATIO=1.5

Vf=30%
PD RATIO=3

Vf=40%
PD RATIO=3

Vf=55%
PD RATIO=3

CIGARETTE WITH A DUAL-STRUCTURE FILTER

BACKGROUND OF THE INVENTION

The present invention relates to a cigarette with a dual-structure filter and, more particularly, to a cigarette with a dual-structure filter, having a high draw resistance and exhibiting a decreased CO/tar ratio in main stream smoke.

With recent changes in the taste of smokers, low-nicotine, low-tar cigarettes are being desired. Accordingly, a plurality of air holes (ventilation holes or vents) are formed in a so-called tip paper for connecting a tobacco rod and a filter along the circumferential direction of the filter. When a smoker inhales smoke, air flows into the filter through these holes to increase the air inflow rate (also called the filter ventilation rate) from the tip paper. When the air inflow rate increases, the air amount in main stream smoke increases, and the concentrations of nicotine and tar relatively decrease.

When the air inflow rate is increased, however, the suction resistance (product air-permeation resistance) of a cigarette product lowers. This lowers the draw resistance during smoking, so the original taste of the product cannot be maintained any longer.

Presently commercially available cigarettes with filters generally have a tar amount of 1 to 15 mg/cigarette and a CO/tar ratio (i.e., the weight ratio of carbon monoxide (CO) to tar contained in the main stream smoke) of 1 or more. Cigarettes having a CO/tar ratio of as high as 1.5 are also marketed. Recently, cigarettes having a CO/tar ratio of less than 1 are being desired.

One method of decreasing the CO/tar ratio is to use a filter having a low tar-filtering efficiency and at the same time increase the filter air-permeability. When a filter having a low tar-filtering efficiency is used, the tar amount in the main stream smoke increases to decrease the CO/tar ratio. When the filter air-permeability is increased, the combustion amount of a cigarette reduces to reduce the tar amount, but the CO/tar ratio does not change substantially. Therefore, the combination of the two can decrease the CO/tar ratio while maintaining the tar amount in the main stream smoke at a predetermined value.

Unfortunately, the just-described method also lowers the product air-permeation resistance of a cigarette.

Particularly, cigarettes having filter ventilation (i.e., having means, such as ventilation holes formed in a tip paper, for flowing air from the circumferential surface of a filter) are said to require a product air-permeation resistance of 90 to 130 $mmH_2O$ in order to maintain a good taste. However, the product air-permeation resistance of cigarettes whose CO/tar ratio is decreased by the above method does not reach 90 $mmH_2O$. This deteriorates the taste of the cigarettes.

As another method of decreasing the CO/tar ratio, Jpn. Pat. Appln. KOKAI Publication No. 62-175162 has disclosed a filter using a special material such as a plastic film, e.g., a polyethylene film, as a filter element. Also, Jpn. Pat. Appln. KOKOKU Publication No. 4-16151 has proposed a filter having a special material and a special structure, such as a filter having a plastic tubular inside member whose tip is crimped. These filters can lower the CO/tar ratio. However, the use of the special materials and structures increases the manufacturing cost and makes the filters difficult to manufacture.

BRIEF SUMMARY OF THE INVENTION

It is, therefore, a first object of the present invention to provide a cigarette with a filter, which can present nicotine and tar at reduced concentrations in the main stream smoke and yet exhibit a high draw resistance, without using any special material or structure.

It is a second object of the present invention to provide a cigarette with a filter, having a CO/tar ratio of less than 1 and still having a satisfactory product air-permeation resistance.

According to the present invention, there is provided a cigarette with a dual-structure filter, comprising a dual-structure filter having a first filter element and a second filter element located downstream of the first filter element; a tobacco rod arranged upstream of the filter; and a tip paper covering a downstream end portion of the tobacco rod and a substantially entire circumferential surface of the filter and having an air inflow means including at least one row of a plurality of holes (ventilation holes) formed in a circumferential direction of the filter, wherein an air-permeation resistance per unit length of the second filter element is at least twice an air-permeation resistance per unit length of the first filter element, and an air inflow rate from the tip paper is 20% or more.

In the present invention, the air inflow rate is preferably 35% or more, and more preferably 60 to 85%.

Further, in the present invention, the air-permeation resistance per unit length of the second filter element is preferably 2 to 7 times the air-permeation resistance per unit length of the first filter element.

Furthermore, in the present invention, the air inflow means preferably has an opening position in a region corresponding to the first filter element, and more preferably, in a range of 4 mm from an upstream end to 10 mm from a downstream end of the filter.

In the present invention, a CO/tar ratio of less than 1 and a product air-permeation resistance of 90 to 130 $mmH_2O$ can be achieved more assuredly when the air-permeation resistance per unit length of the second filter element is 2.5 to 10 times the air-permeation resistance per unit length of the first filter element, the air inflow rate from the tip paper is 20 to 85%, and the air inflow means has an opening position in a range of 4 mm from an upstream end to 10 mm from a downstream end of the filter. In this case, it is more preferable that the air-permeation resistance per unit length of the second filter element be 3 to 7 times the air-permeation resistance per unit length of the first filter element and/or the air inflow rate from the tip paper be 30 to 85%.

In the present invention, the filter may have a length of 15 to 40 mm and a circumference of 20 to 27 mm as in the case of usual cigarettes.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present inventors have focused attention on a dual-structure filter to achieve the objects of the present invention and extensively studied this filter. As is well known to those skilled in the art, a dual-structure filter includes a first filter element and a second filter element. The first filter element is on the upstream side in a direction in which the main stream smoke flows (to be also simply referred to as "upstream" in this specification) when the smoke is inhaled. The second filter element is on the downstream side in this flowing direction of the main stream smoke (to be also simply referred to as "downstream" in this specification). In a cigarette with a conventional dual-structure filter, the air-permeation resistance per unit length of the second filter element is essentially equal to or lower than that of the first filter element.

Unexpectedly, however, the present inventors have found that by making the air-permeation resistance per unit length of the second filter element significantly higher than that of the first filter element, it is possible to significantly increase the product air-permeation resistance of a cigarette and thereby provide a cigarette having a high draw resistance, even when the air inflow rate from a tip paper in which ventilation holes are formed is increased. The present inventors have further made extensive studies on the basis of this knowledge and found that the first object described earlier can be achieved by making the air-permeation resistance per unit length of the second filter element at least twice that of the first filter element in the dual-structure filter, and also setting an air inflow rate from the tip paper at 20% or more. In this way the present inventors have completed the present invention. In particular, the present inventors have found that it is possible to obtain a CO/tar ratio of less than 1 and a product air-permeation resistance of 90 to 130 $mmH_2O$ when the air-permeation resistance per unit length of the second filter element is 2.5 to 10 times that of the first filter element, the air inflow rate from the tip paper is 20 to 85%, and the air inflow means has an opening position within the range of 4 mm from the upstream end to 10 mm from the downstream end of the filter.

The present invention will be described in detail below with reference to the accompanying drawings.

Figure 1:
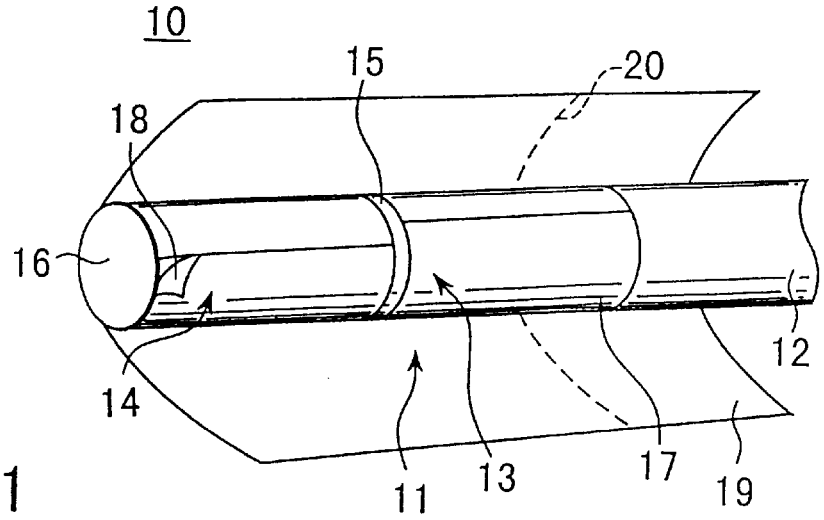
FIG. 1 is a perspective view showing one embodiment of a cigarette with a dual-structure filter according to the present invention.

FIG. 1 is a partially exploded perspective view showing one embodiment of a cigarette with a dual-structure filter (to be simply referred to as a cigarette hereinafter) of the present invention, in a substantially cylindrical form as a whole. A cigarette 10 shown in FIG. 1 has a filter 11 and a tobacco rod 12. The filter 11 and the tobacco rod 12 are connected by a tip paper 19.

The filter 11 includes a first filter element 13 and a second filter element 14 located downstream of the first filter element 13.

The first and second filter elements 13 and 14 are constituted by fibrous materials 15 and 16 which can be identical or different. Examples of the fibrous materials are tows of long fibers such as cellulose acetate, polypropylene, and rayon, crushed pulp, linters, and crape-finished yarns. In respect of the flavor and taste of a cigarette, the first and second filter elements 13 and 14 are preferably made of cellulose acetate fibers or cigarette filter dry nonwoven fabric described in Jpn. Pat. Appln. KOKOKU Publication No. 44-13788. Briefly, the latter nonwoven fabric can be prepared spraying a self-crosslinking copolymer resin of vinyl acetate, acrylic ester and a vinyl monomer having amino, amide, methylol and/or carboxlic group (e.g., 2-aminomethyl vinyl ether, 5-aminobenzyl vinyl ether, acrylamide, methacrylamide, N-methylolacrylamide, hydroxymethyl acrylate, itaconic acid, maleic acid) in the form of O/W emulsion or solution onto a wet pulp web, preferably in an amount of 5 to 40% by weight of the weight of the web, and drying the web.

It is preferable that the first filter element 13 be made of tows of cellulose acetate fibers having a Y cross-section and a filament denier of 5 deniers or more and the second filter element 14 be made of tows of cellulose acetate fibers having a Y cross-section and a filament denier of 2 deniers or less. This is because such filter elements can be manufactured by the existing facilities.

In the cigarette shown in FIG. 1, the fibrous materials 15 and 16 of the first and second elements 13 and 14 are individually covered with wrappers 17 and 18 to form cylindrical plugs, respectively. The wrappers 17 and 18 can be made of an air-permeable porous material or a substance having a plurality of holes. For example, the wrappers 17 and 18 can be conventional air-permeable wrappers. Such wrappers may usually have an air-permeability of 1000 to 50000 mL/cm$^2$/min/100 mmH$_2$O. However, one of the wrappers 17 and 18 can be air-impermeable. Such air-impermeable wrapper is well known in the art. Note that the first and second filter elements 13 and 14 can also be directly wrapped with the tip paper 19 without being wrapped with the wrappers 17 and 18.

It is preferable that the fibrous materials forming the first and second filter elements 13 and 14 be essentially uniform in the entire lengthwise direction and over the entire cross-section of the first and second filter elements 13 and 14. This is because such filter elements can be readily manufactured by using the existing facilities.

The first and second filter elements 13 and 14 can be in contact with each other, or spaced apart from each other in the lengthwise direction as shown in FIG. 1. In the latter case, the gap formed between the first and second filter elements 13 and 14 can be loaded with activated carbon (not shown). Alternatively, the first filter element can be added with activated carbon.

In the present invention, the first and second filter elements 13 and 14 individually wrapped with the wrappers 17 and 18, respectively, can further be integrally covered with a second wrapper and connected to each other. This second wrapper is made of an air-permeable porous material or a material having holes, and may be an air-permeable wrapper identical to the wrapper 17 or 18.

The tobacco rod 12 is arranged upstream of the dual-structure filter 11 as described above, contacting the second filter element 13 in the lengthwise direction of the filter 11. The tobacco rod 12 may be the one used in conventional cigarettes. More specifically, the tobacco rod 12 may be formed by wrapping a tobacco material such as shredded tobacco with conventional air-permeable paper or wrapper. This air-permeable paper may usually have an air-permeability of 10 to 200 mL/cm$^2$/min/100 mmH$_2$O. The air-permeation resistance of the tobacco rod, which is a pressure difference, PD, when the rod is sucked form its one end at an air flow rate of 17.5 cm$^3$/sec without clogging or covering the side (circumference) of the rod, is usually 35 to 100 mmH$_2$O.

The downstream end portion of the tobacco rod 12 and the entire circumferential surface of the filter 11 are wrapped with the tip paper 19. The material of the tip paper 19 is not particularly limited as long as the material is used in conventional cigarettes. For example, an air-impermeable tip paper can be utilized.

The tip paper 19 has an air inflow means comprising at least one row of a plurality of holes (ventilation holes) 20 formed along the circumferential direction of the filter. In the cigarette shown in FIG. 1, these ventilation holes 20 are formed in one row along the circumferential direction of the filter 11. However, the air inflow means can also comprise a plurality of ventilation holes formed in two or more rows.

As is well known in the art, the ventilation holes 20 can be formed by either mechanical means or electrical means. More specifically, after ventilation holes 20 are mechanically or electrically formed in the tip paper 19, the tip paper 19 is wound around the circumferential surfaces of the filter 11 and the downstream end portion of the tobacco rod 12 and adhered at the end portions. Alternatively, the tip paper 19 in which the ventilation holes 20 are not formed yet is wound around the circumferential surfaces of the filter 11 and the tobacco rod 12 and adhered at the end portions, and then ventilation holes 20 are formed by, for example, laser. The air-permeability of the tip paper provided with the ventilation holes is usually 100 to 7000 mL/cm$^2$/min/100 mmH$_2$O.

In the cigarette of the present invention, the air-permeation resistance per unit length of the second filter element 14 is at least twice that of the first filter element 13. In addition, the air inflow rate from the perforated tip paper 19 is 20% or more.

The air-permeation resistance of a filter element is a pressure difference PD (mmH$_2$O) in the filter element measured when the filter element is sucked from its end at an air flow rate of 17.5 cm$^3$/sec, with the filter element covered by an air-impermeable rubber so as to prevent air flowing into the filter element from the side or circumference. The filter air-permeation resistance (open) refers to a pressure difference of a filter portion, measured by cutting apart a filter-fitted cigarette along the contact plane of the tobacco rod and the filter portion, and subjecting the filter portion to suction from its end at an air flow rate of 17.5 cm$^3$/sec, without clogging the side of the filter portion, and is abbreviated as FAPR(open). On the other hand, the filter air-permeation resistance (closed) refers to a pressure difference of the cut-apart filter portion measured when the filter portion is sucked from its end portion at an air flow rate of 17.5 cm$^3$/sec, with the filter portion covered by an air-impermeable rubber so as to prevent air flowing into the filter element from the ventilation holes, and is abbreviated as FAPR (closed).

The air inflow rate or filter ventilation rate (Vf) is the ratio, represented by percentage, of the flow rate of air flowing into a cigarette (with a filter) through a tip paper (having an air inflow means) to the flow rate of a gas (a mixture of smoke and air) at the end of the foot when the cigarette is smoked at a standard air flow rate of 17.5 cm$^3$/sec.

When the air-permeation resistance per unit length of the second filter element 14 is set at least twice that of the first filter element 13 and the air inflow rate from the perforated tip paper 19 is set at 20% or more according to the present invention, a dual-structure filter cigarette having a high draw resistance is provided although the concentrations of nicotine and tar in the main stream smoke are decreased (because the air inflow rate is as high as 20% or more). Cigarettes of the present invention can have a CO/tar ratio of less than 1.0 and a product air-permeation resistance of 90 to 130 $mmH_2O$.

The product air-permeation resistance is a pressure difference PD ($mmH_2O$) when a cigarette is drawn by suction at a flow rate of 17.5 $cm^3$/sec without closing ventilation holes formed in a tip paper of the cigarette, and is abbreviated as PAPR. The product air-permeation resistance thus measured with ventilation holes open is sometimes also called a product air-permeation resistance (open) or PAPR (open).

As is well known in the art, an air-permeation resistance or PD of a filter element may be adjusted by an appropriate selection of the fiber diameter and/or filling amount of the fiber materials used. On the other hand, a filter ventilation rate, Vf, may be adjusted by an appropriate selection of the size and/or the number of ventilation holes, and/or the number of rows of ventilation holes.

In the present invention, the ratio of the air-permeation resistance or PD per unit length of the second filter element/the air-permeation resistance or PD per unit length of the first filter element(to be also simply referred to as a filter element PD ratio, or more simply as a PD ratio hereinafter) is preferably 2 to 7, and the air inflow rate Vf is preferably 35% or more, and more preferably, 60 to 85%. In this case, the present invention can significantly increase the product air-permeation resistance (by, e.g., 10 $mmH_2O$ or more compared to conventional dual-structure filter cigarettes) while maintaining a high air inflow rate in so-called low-tar cigarettes having a tar amount of 1 to 3 mg per cigarette. Consequently, cigarettes having a low tar amount and a high draw resistance can be provided. However, the present invention can significantly increase the product air-permeation resistance by setting the air inflow rate at 35 to 60% not only in low-tar cigarettes but also in medium-tar cigarettes having a tar amount of 4 to 10 mg per cigarette.

Furthermore, in the present invention, the air inflow means preferably has an opening position in that region of the tip paper which corresponds to the first filter element. This reason will be described below with reference to FIGS. 2A to 2C.

As a model, assume that the filter 11 has a filter length of 25 mm, a first filter element 13 having a length of 10 mm and an air-permeation resistance of 25 $mmH_2O$, a second filter element having a length of 15 mm and an air-permeation resistance of 75 $mmH_2O$, and a filter element PD ratio of 2.0. The circumference of this filter 11 is covered with the tip paper 19.

Figure 2A:
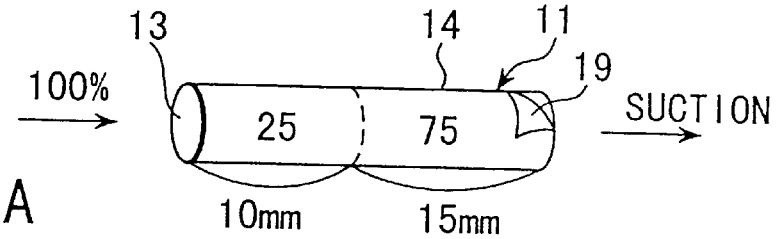
FIGS. 2A to 2C are schematic perspective views for explaining the opening position of air inflow means in a cigarette with a dual-structure filter according to the present invention.

As shown in FIG. 2A, when the filter 11 is drawn from its foot by suction at a fixed flow rate, without forming ventilation holes 20 in the tip paper 19, the ratio of air flowing into the filter 11 from its upstream end is 100%. Consequently, the FAPR (closed) of the filter 11 is the total of the air-permeation resistances of the first and second filter elements 13 and 14, i.e., 100 $mmH_2O$.

Figure 2B:
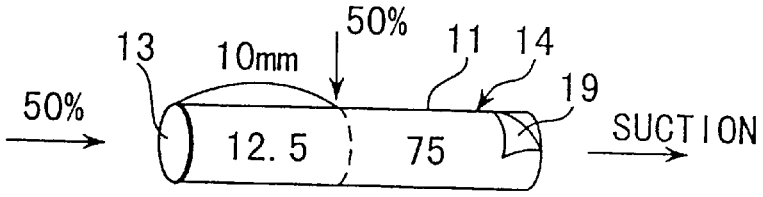

In FIG. 2B, ventilation holes 20 are formed in a position 10 mm apart from the upstream end of the filter 11, i.e., in that portion of the tip paper 19, which corresponds to the connected portion of the first and second filter elements 13 and 14. When the air inflow rate from the ventilation holes 20 is set at 50% and the filter 11 is drawn from its foot by suction at a fixed flow rate, 50% of the air flowing into the filter 11 is through the upstream end of the filter. Consequently, the apparent air-permeation resistance of the first filter element 13 decreases to 12.5 $mmH_2O$, so the FAPR (open) of the filter 11 decreases to 87.5 $mmH_2O$.

Figure 2C:
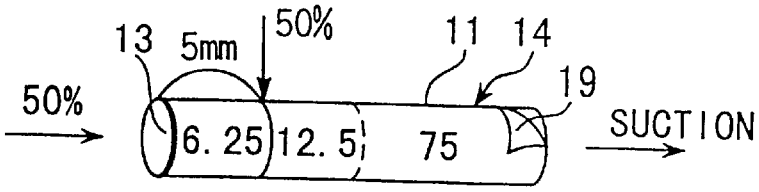

In FIG. 2C, ventilation holes 20 are formed in a position 5 mm apart from the upstream end of the filter 11, i.e., in that portion of the tip paper 19, which corresponds to the center in the longitudinal direction of the first filter element 13. When the air inflow rate from the ventilation holes 20 is set at 50% and the filter 11 is drawn from its foot by suction at a fixed flow rate, 50% of the air flowing into the filter 11 is through the upstream end of the filter. In this case, the apparent air-permeation resistance is 6.25 $mmH_2O$ in that portion of the first filter element 13 which is upstream of the opening position. On the other hand, the apparent air-permeation resistance is 12.5 $mmH_2O$ in a portion downstream of the opening position due to air flowing from the ventilation holes 20. Consequently, the FAPR (open) of the filter 11 becomes 93.75 $mmH_2O$. Incidentally, the product air-permeation resistance is the sum of the apparent air-permeation resistance of the tobacco rod and the FAPR (open). The apparent air-permeation resistances of the tobacco rods are the same for the cigarettes of FIGS. 2B and 2C. Consequently, the results that the FAPR (open) of FIG. 2C is larger than that of FIG. 2B can be applied to the product air-permeation resistance.

As described above, when the opening position of the ventilation holes 20 is set in that portion of the tip paper, which corresponds to the first filter element, the product air-permeation resistance of the cigarette 10 can be increased compared to the case wherein the opening position of the ventilation holes 20 is set in a portion immediately above or downstream of the connected portion of the first and second filter elements 13 and 14.

Note that the opening position is the position, in the lengthwise direction of the filter 11, of the ventilation holes formed in the tip paper 19. When a plurality of ventilation holes are formed in one row in the circumferential direction as shown in FIG. 1, the opening position is the position of the center of the ventilation holes 20. When the air inflow means comprises a plurality of rows of ventilation holes 20 are formed, the opening position is the position, in the lengthwise direction of the filter 11, of the center of the two ventilation hole rows, that are most remotely apart of the all rows.

More specifically, it is preferred that the opening position of the ventilation holes 20 of the tip paper 19 be present in that region of the tip paper which corresponds to the first filter element 13, and is between 4 mm from the upstream end and 10 mm from the downstream end (foot end) of the filter 11. If the opening position is less than 4 mm from the upstream end of the filter 11, the upstream end and its vicinity of the filter 11 cannot be coated with an adhesive for connecting the filter 11 and the tobacco rod 12 when the tip paper 19 in which the ventilation holes 20 are formed is adhered to the circumferences of the filter 11 and the tobacco rod 12. This significantly decreases the mechanical strength of the cigarette 11. If the opening position is less than 10 mm from the downstream end of the filter 11, the effect of increasing the product air-permeation resistance may not be achieved and further the ventilation holes 20 may be closed with lips during smoking.

In the present invention, when the air-permeation resistance per unit length of the second filter element 14 is set at 2.5 to 10 times that of the first filter element 13, the air inflow rate from the tip paper 19 is set at 20 to 85%, and the air inflow means is has an opening position within the range of 4 mm from the upstream end to 10 mm from the downstream end as described above, it is possible to more reliably obtain a CO/tar ratio of less than 1 and a product air-permeation resistance of 90 to 130 $mmH_2O$. In this case, it is more preferable that the PD ratio of the second filter element to the first filter element be 3 to 7 and the air inflow rate Vf be 30 to 85%.

In the present invention, the first filter element 13 may have an air-permeation resistance of 1 to 4 mm $H_2O$/mm.

Further, in the present invention, the filter 11 can have a length of 15 to 40 mm and a circumferential length of 20 to 27 mm like filters of conventional filter cigarettes.

As described above, the cigarette of the present invention can simultaneously achieve the two requirements, i.e., decreasing the CO/tar ratio to less than 1.0 and maintaining the product air-permeation resistance at 90 $mmH_2O$ or more, that are generally incompatible with each other.

Additionally, the cigarette of the present invention does not require any special filter material nor special structure. This prevents an increase in the manufacturing cost.

EXAMPLES

Experiments were conducted to check the effects of the cigarette of the present invention as follows.

Experiment I

Sample cigarettes having lot numbers I-1 to I-7 shown in Table 1 were manufactured as follows.

First and second filter elements were obtained by wrapping cellulose acetate tows having filament weights (deniers), fiber cross-sectional shapes, and total tow weights (deniers) shown in Table 1 with wrappers having wrapper air-permeabilities shown in Table 1 and forming the resultant materials into the shape of a plug, respectively. The lengths and air-permeation resistances of the resultant first and second filter elements are shown in Table 1.

These first and second filter elements were arranged upstream and downstream, respectively, along the longitudinal direction to form filters by wrapping with a second wrapper. The PD ratios of these filters and the permeabilities of the second wrappers and air-permeation resistances of the finished filter products are also shown in Table 1.

Portions of separately prepared tobacco rods and the circumferential surfaces of the filters were covered with apertured tip papers (width 30 mm) having air-permeabilities, numbers of ventilation hole rows formed by laser, and ZC values shown in Table 1. In this manner the sample cigarettes I-1 to I-7 were obtained. In Table 1 (and Table 2), "ZC" is the distance from the foot end of the filter to the opening position.

Note that the characteristics of the sample cigarettes except for the filters and tip papers were based on the regular cigarette standards. That is, blended shredded tobacco for cigarettes was used as shredded tobacco, and the filling amount of the shredded tobacco was 703 mg per cigarette. Also, a paper having a permeability of 24 $mL/cm^2/min/100$ $mmH_2O$ was used as the paper for wrapping the tobacco rod. The cigarette dimensions were a tobacco rod length of 59 mm, a filter length of 25 mm, a cigarette circumferential length of 24.8 mm, and a tip paper width of 30 mm.

These sample cigarettes I-1 to I-7 were conditioned at a temperature of 22° C. and a humidity of 60% RH for 48 hours or more. All the conditioned sample cigarettes were measured for their weights, their PAPR (open) and their Vf values, using a cigarette quality-measuring device, and the averages of each measured items were calculated. Of the samples, those satisfying the criteria of the average weight ±10 mg, the average air-permeation resistance±5 $mmH_2O$, the average Vf±2% were selected and subjected to experiment.

TABLE 1

| | Filter | | | | | | | |
|---|---|---|---|---|---|---|---|---|
| | | | Finished Product | | First Filter Element | | | |
| Lot No. | Type | PD Ratio | Inherent Air-Permeability of the Second Wrapper * | Air-Permeation Resistance (closed) ** | Tow *** | Inherent Air-Permeability of the Wrapper * | Length **** | Air-Permeation Resistance ** |
| I-1 | Dual | 1.0 | 10000 | 71 | 3Y/36000 | 10000 | 10 | 28 |
| I-2 | | 4.1 | 10000 | 71 | 14Y/30000 | 10000 | | 10 |
| I-3 | | 1.0 | 30000 | 122 | 2.2Y/40000 | 30000 | | 49 |
| I-4 | | 0.5 | 30000 | 123 | 1.5Y/44000 | 30000 | | 73 |
| I-5 | | 2.0 | 30000 | 123 | 4Y/40000 | 30000 | | 31 |
| I-6 | | 6.8 | 30000 | 121 | 14Y/30000 | 30000 | | 11 |
| I-7 | | 6.7 | 30000 | 121 | 14Y/30000 | 30000 | | 11 |

| | Filter Second Filter Element | | | | Tip Paper | | |
|---|---|---|---|---|---|---|---|
| Lot No. | Tow *** | Inherent Air-Permeability of the Wrapper * | Length **** | Air-Permeation Resistance ** | Number of Rows of Ventilation holes | Air-Permeability * | ZC ***** |
| I-1 | 3Y/36000 | 10000 | 15 | 43 | 2 | 600 | 14 |
| I-2 | 2.2Y/40000 | 10000 | | 61 | 2 | 600 | 14 |
| I-3 | 2.2Y/40000 | 30000 | | 73 | 4 | 2400 | 14 |

TABLE 1-continued

| | | | | | | |
|---|---|---|---|---|---|---|
| I-4 | 3Y/36000 | 30000 | 50 | 4 | 2400 | 14 |
| I-5 | 1.5Y/44000 | 30000 | 92 | 4 | 2400 | 14 |
| I-6 | 1.5Y/44000 | 30000 | 112 | 4 | 2400 | 14 |
| I-7 | 1.5Y/44000 | 30000 | 110 | 4 | 2400 | 19 |

*Air-Permeability: Unit mL/cm$^2$/min/100 mm $H_2O$
**Air-Permeation Resistance: Unit mm $H_2O$
***Tow: Filament weight (Denier) · Cross-Section/Tow weight (Denier)
****Length: Unit mm
*****ZC: Unit mm The PAPR, air inflow rate (Vf), nicotine, tar, CO gas delivery amount, and puff number of each of the sample cigarettes I-1 to I-7 as described above were measured under standard smoking conditions by using an 8-cigarette smoking apparatus available from Filtrona Co. Also, the CO/tar ratio was calculated from the obtained measured values.

The results are shown in Table 2.

Experiment II (A) Simulation

A cigarette with a dual-structure filter capable of obtaining a low CO/tar ratio and maintaining a high product air-permeation resistance, i.e., capable of achieving a high air-permeation resistance and a low filtering efficiency was examined by using simulation.

TABLE 2

| | Filter | | Cigarette Product | | | | | | | |
|---|---|---|---|---|---|---|---|---|---|---|
| Lot No. | PD Ratio | Air-Permeation Resistance (closed) (mm $H_2O$) | ZC (mm) | Product Air-Permeation Resistance (mm $H_2O$) | VF (%) | Puff Number | Tar (mg/cig) | Nicotine (mg/cig) | CO (mg/cig) | CO/Tar ratio |
| I-1 | 1.0 | 71 | 14 | 86 | 35 | 7.9 | 9.7 | 1.12 | 9.2 | 0.96 |
| I-2 | 4.1 | 71 | 14 | 96 | 35 | 8.0 | 9.8 | 1.14 | 9.2 | 0.94 |
| I-3 | 1.0 | 122 | 14 | 89 | 76 | 9.0 | 2.1 | 0.29 | 2.1 | 0.99 |
| I-4 | 0.5 | 123 | 14 | 76 | 75 | 8.9 | 1.9 | 0.26 | 2.1 | 1.12 |
| I-5 | 2.0 | 123 | 14 | 106 | 76 | 8.9 | 2.3 | 0.31 | 2.1 | 0.90 |
| I-6 | 6.8 | 121 | 14 | 118 | 76 | 9.0 | 2.6 | 0.34 | 2.1 | 0.83 |
| I-7 | 6.7 | 121 | 19 | 128 | 76 | 9.0 | 2.8 | 0.37 | 2.1 | 0.76 |

As is apparent from Table 2, when the air inflow rate (Vf) was as low as 35% and ZC was 14 mm, the sample cigarette I-2 having a PD ratio of 4.1 was increased in the PAPR and decreased in the CO/tar ratio from 0.96 to 0.94 compared to the sample cigarette I-1 having a PD ratio of 1.0.

Also, when the air inflow rate (Vf) was as high as 75 or 76% and ZC was 14 mm, the sample cigarettes I-5 and I-6 having PD ratios of 2.0 and 6.8 were increased in the PAPR and decreased in the CO/tar ratios compared to the sample cigarettes I-3 and I-4 having PD ratio of 0.5 and 1.0.

Thus, it was confirmed that when the PD ratio is 2.0 or more, i.e., when the air-permeation resistance per unit length of the second filter element is at least twice that of the first filter element, it is possible to increase the PAPR and decrease the CO/tar ratio compared to a case wherein the PD ratio is 1.0, i.e., the air-permeation resistances per unit length of the first and second filter elements are equal or a case wherein the PD ratio is 0.5, i.e., the air-permeation resistance per unit length of the first filter element is twice that of the second filter element. Also, it was found that the higher the PD ratio, the larger the increase in the PAPR and the larger the decrease in the CO/tar ratio.

Comparing the sample cigarettes I-6 and I-7 having essentially equal PD ratios of 6.8 and 6.7 and different ZC values of 14 and 19 mm reveals that the sample cigarette I-7 in which ZC was larger than the length (15 mm) of the second filter element, i.e., ventilation holes were formed on the first filter element side increased the PAPR and decreased the CO/tar ratio compared to the sample cigarette I-6 in which ZC was smaller than the length (15 mm) of the second filter element.

To predict the air-permeation resistance and tar-filtering efficiency of a filter, a predicting equation for general dual-structure filters can be applied.

If there is no inflow air from the circumference, the relationship between a flow rate Q (cm$^3$/sec) of a fluid flowing through a filter and an air-permeation resistance $\Delta P$ (cm$H_2O$) obeys the Darcy rule (Fordyce, W. B., I. W. Hughes and M. G. Ivinson; Tob. Sic., 75, 20–25 (1961)), represented by the following equation (1):

$$\Delta P=\lambda\cdot L(Q/A) \tag{1}$$

where $\lambda$ (cm$H_2O$·sec/cm$^2$) is the impedance coefficient of the filter, L (cm) is the length of the filter, and A (cm$^2$) is the cross-sectional area of the filter.

On the other hand, a tar-filtering efficiency $E_0$ of a cellulose acetate filter 2.47 cm in circumference and 2.5 cm in length is simply described by a DWYER experimental equation (2):

$$E_0=1-exp[-\Delta P\{0.0111+(0.371/Q)+4.54Q^{(-5/3)}\}] \tag{2}$$

Accordingly, a tar-filtering efficiency E of a filter having a length L is calculated using a logarithmic transmission rule by the following equation (3):

$$E=1-(1-E_0)^{L/2.5} \tag{3}$$

The dual-structure filter is divided into three regions when the difference between the air-permeation resistances of the first and second filter elements and the change in flow rate in the filter caused by the ventilation holes are taken into consideration. Letting $\Delta P_1$, $\Delta P_2$ and $\Delta P_3$, and $E_1$, $E_2$ and $E_3$ be the air-permeation resistances and tar-filtering efficiencies in these three regions, an air-permeation resistance $\Delta P_T$ and a tar-filtering efficiency $E_T$ Of the dual-structure filter are respectively given by the following equations (4) and (5), respectively:

$$\Delta P_T = \Delta P_1 + \Delta P_2 + \Delta P_3 \quad (4)$$

$$E_T = 1-(1-E_1)(1-E_2)(1-E_3) \quad (5)$$

Equations (1) to (5) introduced as above were combined with the combustion characteristics of usual cigarettes to predict the PAPR, puff number, tar, nicotine, and CO gas amount. In this simulation, actually measured values were given as the FAPR (closed) and the filter ventilation rate (Vf).

(B) Actual measurements

Values were actually measured to confirm the applicability of simulation results to cigarettes actually prepared. That is, a dual-structure filter having a PD ratio of 2.8 according to the present invention (prepared in a manner similar to Experiment II) and two plain filters 1 and 2 (comparative examples) having different air-permeation resistances were prepared as shown in Table 3. A plain filter is a filter having a single filter element. Cellulose acetate was used as a fiber material in filter elements of these filters. These filters were wrapped with four types of apertured tip papers having different air-permeabilities. The characteristics except for the filters and the tip papers were based on the regular cigarette standards. That is, in this experiment, blended shredded tobacco for cigarettes was used as shredded tobacco, and the filling amount of the shredded tobacco was 703 mg per cigarette. Also, a paper having a permeability of 24 mL/cm$^2$/min/100 mmH$_2$O was used as the paper for wrapping the tobacco rod. The cigarette dimensions were a tobacco rod length of 59 mm, a filter length of 25 mm, and a cigarette circumference of 24.8 mm. The dimensions of the tip papers were ZC of 14 mm and a width of 30 mm. One, two, or four rows of ventilation holes were formed in these tip papers. The air-permeability of each apertured tip paper was 200, 600, or 1,200. "ZC" is the distance from the foot end of the filter to the opening position.

These sample cigarettes II-1 to II-12 were conditioned at a temperature of 22° C. and a humidity of 60% RH for 48 hours or more. All the conditioned sample cigarettes were measured for their weights, their PAPR (open) and their Vf values, using a cigarette quality-measuring device, and the averages of each measured items were calculated. Of the samples, those satisfying the criteria of the average weight±10 mg, the average air-permeation resistance±5 mmH$_2$O, and the average Vf±2% were selected and subjected to the experiment.

TABLE 3

| | Filter | | | | | | | |
|---|---|---|---|---|---|---|---|---|
| | | | Finished Product | | First Filter Element | | | |
| Lot No. | Type | PD Ratio | Inherent Air-Permeability of the Second Wrapper * | Air-Permeation Resistance ** | Tow *** | Inherent Air-Permeability of the Wrapper * | Length **** | Air-Permeation Resistance ** |
| II-1 | Plain | — | — | 88 | 2.2Y/ | 10000 | 25 | 88 |
| II-2 | 1 | | | | 40000 | | | |
| II-3 | | | | | | | | |
| II-4 | | | | | | | | |
| II-5 | Plain | — | — | 106 | 1.9Y/ | 10000 | 25 | 106 |
| II-6 | 2 | | | | 44000 | | | |
| II-7 | | | | | | | | |
| II-8 | | | | | | | | |
| II-9 | Dual | 2.8 | 10000 | 98 | 5Y/ | 10000 | 10 | 19 |
| II-10 | | | | | 35000 | | | |
| II-11 | | | | | | | | |
| II-12 | | | | | | | | |

| | Filter | | | | Tip Paper | |
|---|---|---|---|---|---|---|
| | Second Filter Element | | | | Number of | |
| Lot No. | Tow *** | Inherent Air-Permeability of the Wrapper * | Length **** | Air-Permeation Resistance ** | Rows of Ventilation holes | Air-Permeability * |
| II-1 | — | — | — | — | 1 | 200 |
| II-2 | | | | | 2 | 600 |
| II-3 | | | | | 2 | 1200 |
| II-4 | | | | | 4 | 1200 |
| II-5 | — | — | — | — | 1 | 200 |
| II-6 | | | | | 2 | 600 |
| II-7 | | | | | 2 | 1200 |
| II-8 | | | | | 4 | 1200 |
| II-9 | 1.9Y/ | 10000 | 15 | 79 | 1 | 200 |

TABLE 3-continued

| | | | |
|---|---|---|---|
| II-10 | 44000 | 2 | 600 |
| II-11 | | 2 | 1200 |
| II-12 | | 4 | 1200 |

*Air-Permeability: Unit mL/cm$^2$/min/100 mm $H_2O$
**Air-Permeation Resistance: Unit mm $H_2O$
***Tow: Filament Weight (Denier) · Cross-Section/Tow Weight (Denier)
****Length: Unit mm The nicotine, tar, CO gas delivery amount, and puff number of each of the sample cigarettes II-1 to II-12 as described above were measured under standard smoking conditions by using an 8-cigarette smoking apparatus available from Filtrona Co. The results are shown in Table 4.

TABLE 4

| | Filter | | Cigarette Product | | | | | | |
|---|---|---|---|---|---|---|---|---|---|
| Lot No. | Filter Type | Air-Permeation Resistance (closed) (mm $H_2O$) | Product Air-Permeation Resistance (mm $H_2O$) | Vf (%) | Puff Number | Tar (mg/cig) | Nicotine (mg/cig) | CO (mg/cig) | CO/Tar ratio |
| II-1 | Plain | 88 | 110 | 26 | 7.9 | 9.7 | 1.15 | 10.8 | 1.12 |
| II-2 | 1 | | 88 | 53 | 8.4 | 6.2 | 0.79 | 6.2 | 1.01 |
| II-3 | | | 78 | 65 | 8.8 | 4.6 | 0.62 | 4.3 | 0.94 |
| II-4 | | | 74 | 67 | 8.7 | 4.3 | 0.59 | 3.9 | 0.90 |
| II-5 | Plain | 106 | 126 | 28 | 7.9 | 8.4 | 0.96 | 10.5 | 1.25 |
| II-6 | 2 | | 101 | 54 | 8.5 | 5.1 | 0.69 | 6.0 | 1.16 |
| II-7 | | | 91 | 66 | 8.8 | 3.4 | 0.47 | 3.8 | 1.12 |
| II-8 | | | 88 | 67 | 9.0 | 3.2 | 0.46 | 3.4 | 1.07 |
| II-9 | Dual | 97 | 127 | 21 | 7.6 | 10.4 | 1.17 | 12.0 | 1.16 |
| II-10 | | | 113 | 38 | 8.1 | 8.0 | 0.99 | 9.0 | 1.11 |
| II-11 | | | 109 | 47 | 8.3 | 6.7 | 0.87 | 6.8 | 1.02 |
| II-12 | | | 104 | 53 | 8.5 | 5.9 | 0.79 | 5.8 | 0.98 |

FIGS. 3A to 5B were prepared based on the simulation results and using the results shown in Table 4.

Figure 3A:
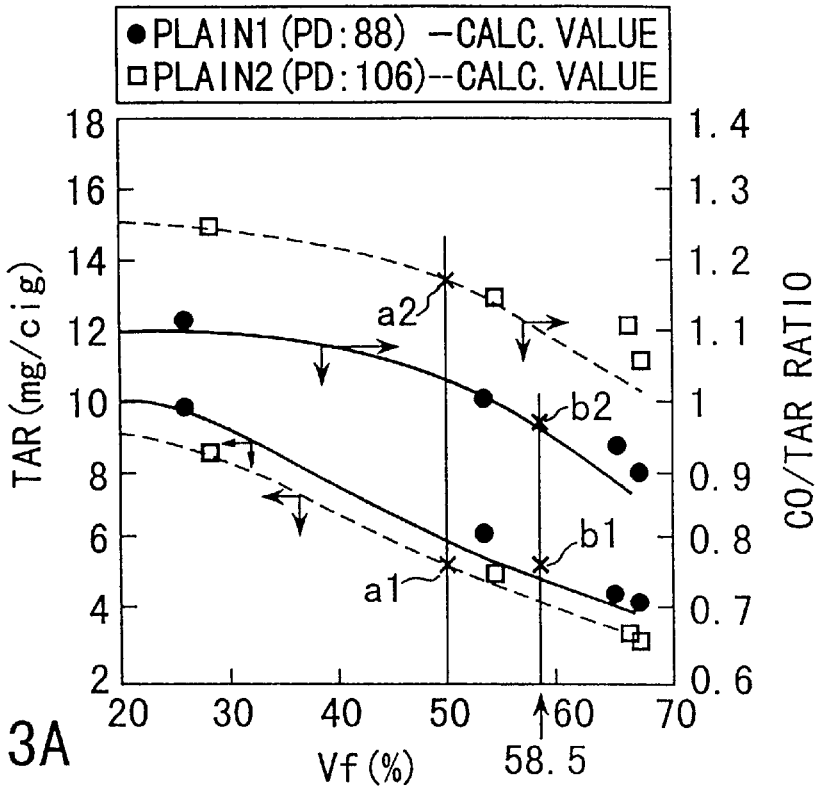
FIG. 3A is a graph showing the tar amount per cigarette and the CO/tar ratio as functions of Vf in cigarettes as comparative examples.

FIG. 3A shows the tar amount per cigarette and the CO/tar ratio as functions of the filter ventilation rate (Vf) (%) in cigarettes using plain filters 1 and 2 having different FAPRs (closed) (88 mm$H_2O$, 106 mm$H_2O$).

Figure 3B:
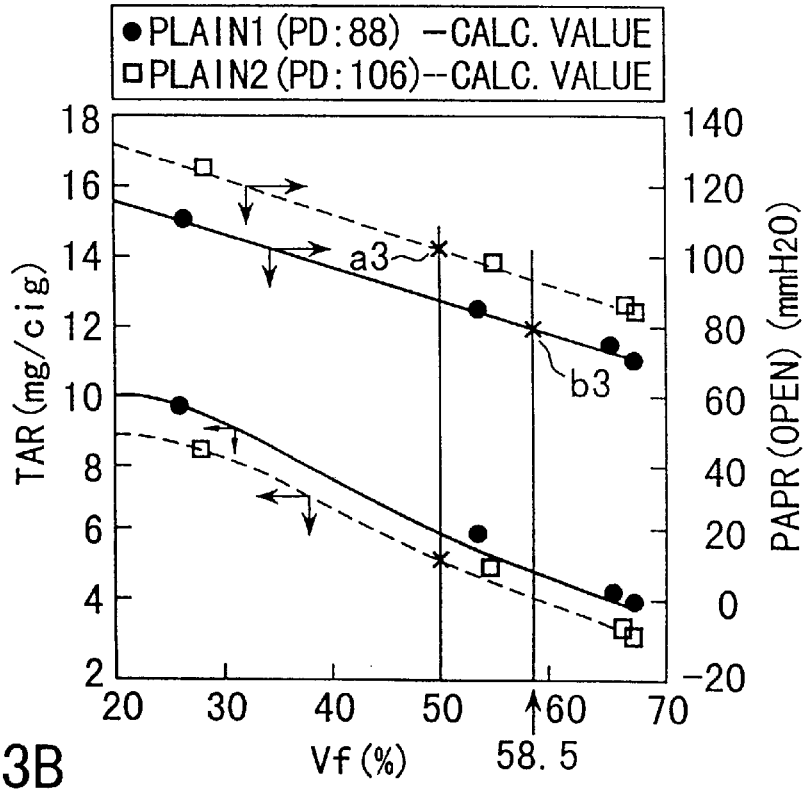
FIG. 3B is a graph showing the tar amount per cigarette and the product air-permeation resistance as functions of Vf in the cigarettes as comparative examples shown in FIG. 3A.

FIG. 3B shows the tar amount per cigarette and the product air-permeation resistance (PAPR (open)) as functions of the filter ventilation rate (Vf) (%) in cigarettes using plain filters 1 and 2.

Referring to FIGS. 3A and 3B, the plots indicate actually measured values, and the solid and broken lines indicate values calculated by simulation for these cigarettes.

With reference to FIGS. 3A and 3B, a conventional technique of decreasing the CO/tar ratio while maintaining the tar amount will be described below.

A cigarette provided with a plain filter (plain 2 in FIGS. 3A and 3B) whose FAPR is 106 mm$H_2O$, and having Vf of 50% was used as a control. A plain filter is equivalent to a dual-structure filter in which the PD ratio is approximately 1, i.e., the air-permeation resistances of the first and second filter elements have no significant difference.

The tar amount in this control was 5.3 mg as indicated by a point a1 in FIG. 3A. The CO/tar ratio of the control was 1.18 as indicated by a point a2 in FIG. 3A. The PAPR of the control was 102 mm$H_2O$ as indicated by a point a3 in FIG. 3B.

In a cigarette having a plain filter (plain 1) with an FAPR reduced to 88 mm$H_2O$ and with Vf increased to 58.5% in order to decrease the CO/tar ratio while maintaining the tar amount by using the conventional technique, the tar amount was 5.3 mg as indicated by a point b1 in FIG. 3A. The CO/tar ratio of the cigarette was 0.96 as indicated by a point b2 in FIG. 3A. The PAPR of the cigarette was 82 mm$H_2O$ as indicated by a point b3 in FIG. 3B.

That is, it was possible to decrease the CO/tar ratio from 1.18 to 0.96 while maintaining 5.3 mg of tar by decreasing the FAPR (closed) from 106 to 88 mm$H_2O$ and increasing Vf from 50% to 58.5%. However, the PAPR that was 102 mm$H_2O$ in the control cigarette largely dropped to 82 mm$H_2O$ in the cigarette having plain 1 whose CO/tar ratio was decreased by the conventional technique.

Figure 4A:
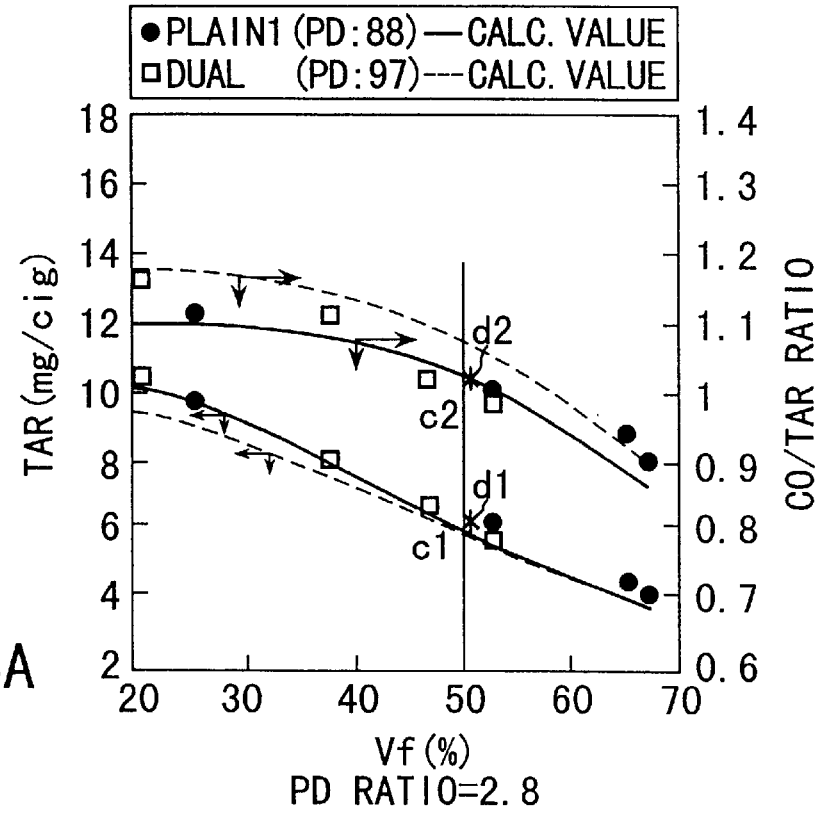
FIG. 4A is a graph showing the tar amount per cigarette and the CO/tar ratio as functions of Vf in a plane filter cigarette 1 (PD=88 $mmH_2O$) as a comparative example and a dual-structure filter cigarette (PD=97 $mmH_2O$, PD ratio=2.8) according to the present invention.

FIG. 4A shows the tar amount per cigarette and the CO/tar ratio as functions of Vf (%) in a cigarette using plain filter 1 having an FAPR (closed) of 88 mm$H_2O$ and a cigarette using a dual-structure filter having an FAPR (closed) of 97 mm$H_2O$ and a PD ratio of 2.8.

Figure 4B:
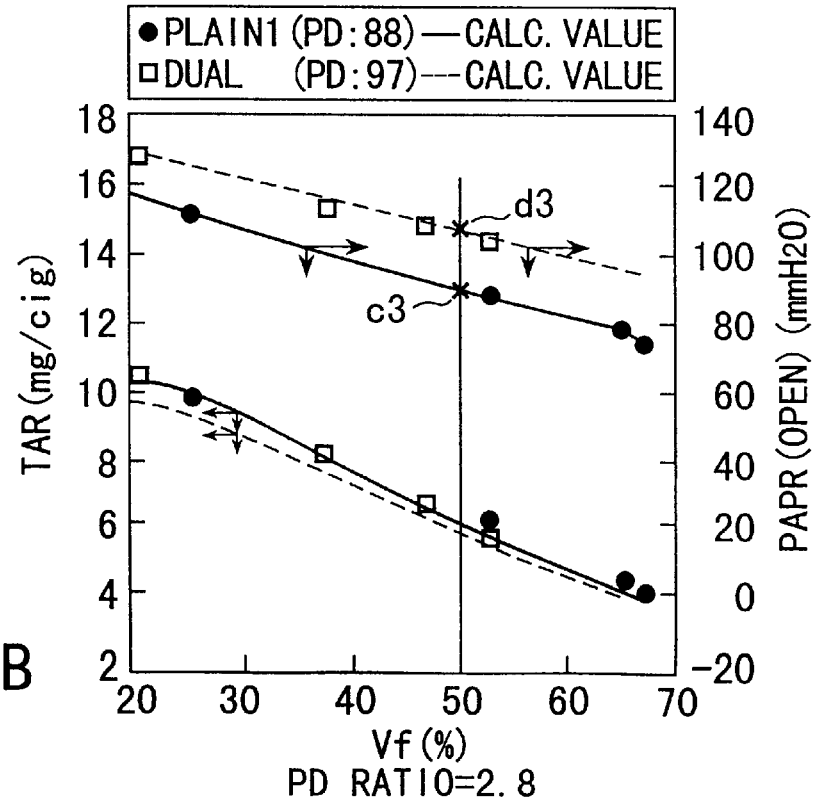
FIG. 4B is a graph showing the tar amount per cigarette and the product air-permeation resistance as functions of Vf (%) in the cigarettes shown in FIG. 4A.

FIG. 4B shows the tar amount per cigarette and the PAPR as functions of Vf (%) in cigarettes using the same filters as in FIG. 4A.

Referring to FIGS. 4A and 4B, the plots indicate actually measured values, and the solid and broken lines indicate values calculated by simulation for these cigarettes.

With reference to FIGS. 4A and 4B, the effect of the dual-structure filter according to the present invention will be described below.

A cigarette with a plain filter (plain 1) whose FAPR is 88 mm$H_2O$ and having Vf of 50% was used as a control.

The tar amount in this control was 6.3 mg as indicated by a point cl in FIG. 4A. The CO/tar ratio of the control was 1.02 as indicated by a point c2 in FIG. 4A. The PAPR of the control was 90 mm$H_2O$ as indicated by a point c3 in FIG. 4B.

A cigarette having a dual filter whose FAPR is 97 mm$H_2O$ and whose PD ratio is 2.8 and having Vf of 50% was used as an embodiment of the cigarette of present invention. The tar amount in this dual-filter cigarette according to the embodiment was 6.3 mg as indicated by a point d1 in FIG. 4A. The CO/tar ratio of the cigarette was 1.02 as indicated by a point d2 in FIG. 4A. The PAPR of the cigarette was 106 $mmH_2O$ as indicated by a point d3 in FIG. 4B.

That is, compared to the control, the dual-structure filter cigarette according to the embodiment could increase the PAPR while holding the tar amount and the CO/tar ratio at their respective same values as the control.

Figure 5A:
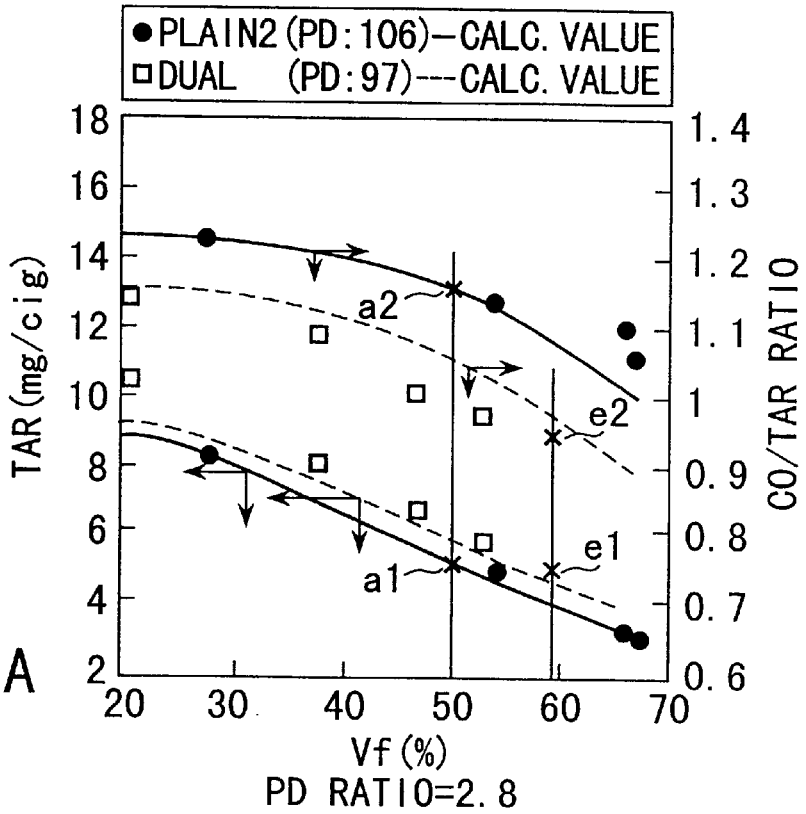
FIG. 5A is a graph showing the tar amount per cigarette and the CO/tar ratio as functions of Vf in plane filter cigarette 2 (PD=106 $mmH_2O$) as a comparative example and a dual-structure filter cigarette (PD=97 $mmH_2O$, PD ratio=2.8) according to the present invention.

FIG. 5A shows the tar amount per cigarette and the CO/tar ratio as functions of Vf (%) in a cigarette using plain filter 2 having an FAPR (closed) of 106 $mmH_2O$ and a cigarette using a dual-structure filter having an FAPR (closed) as a whole of 97 $mmH_2O$ and a PD ratio of 2.8.

Figure 5B:
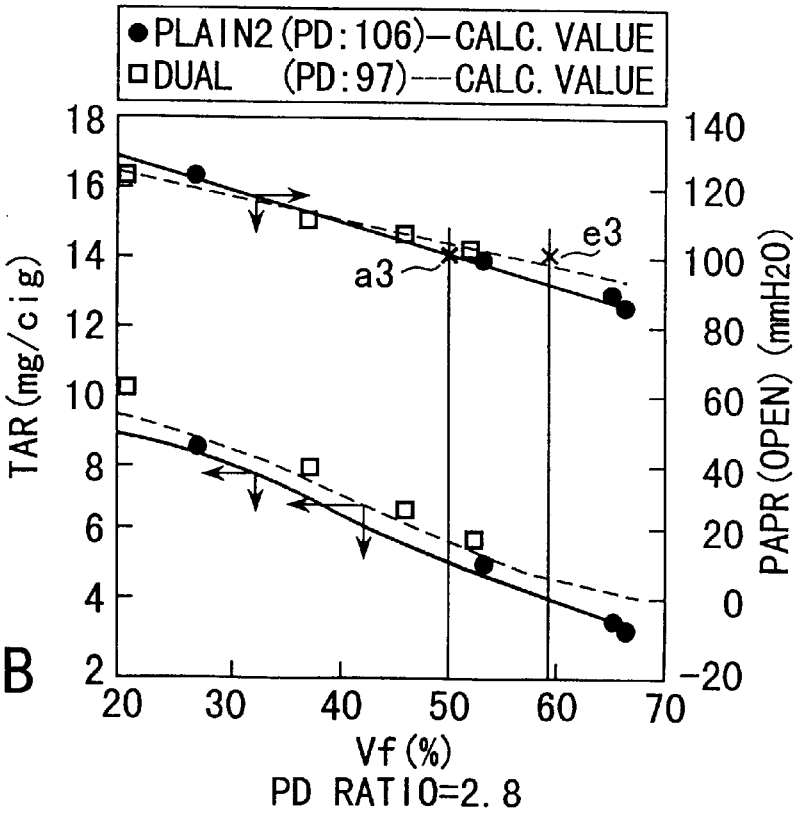
FIG. 5B is a graph showing the tar amount per cigarette and the product air-permeation resistance as functions of Vf (%) in the cigarettes shown in FIG. 5A.

FIG. 5B shows the tar amount per cigarette and the PAPR as functions of Vf (%) in cigarettes using the same filters as in FIG. 5A.

Referring to FIGS. 5A and 5B, the plots indicate actually measured values, and the solid and broken lines indicate values calculated by simulation for these cigarettes.

With reference to FIGS. 5A and 5B, the effect of the dual filter according to the present invention will be described below.

A cigarette having a plain filter (plain 2) whose FAPR of 106 $mmH_2O$ and having Vf of 50% was used as a control.

The tar amount in this control was 5.3 mg as indicated by a point a1 in FIG. 5A. The CO/tar ratio of the control was 1.18 as indicated by a point a2 in FIG. 5A. The PAPR of the control was 102 $mmH_2O$ as indicated by a point a3 in FIG. 5B.

A cigarette including a dual-structure filter whose FAPR (closed) is 97 $mmH_2O$ and whose PD ratio is 2.8 and having Vf of 59% was used as an embodiment of the cigarette of the present invention. The tar amount in this dual-structure filter cigarette according to the embodiment was 5.3 mg as indicated by a point e1 in FIG. 5A. The CO/tar ratio of the cigarette was 0.95 as indicated by a point e2 in FIG. 5A. The PAPR of the cigarette was 102 $mmH_2O$ as indicated by a point e3 in FIG. 5B.

That is, compared to the control, the cigarette of the present invention could decrease the CO/tar ratio from 1.18 to 0.95 while maintaining a tar amount of 5.3 mg and a PAPR of 102 $mmH_2O$.

As described above, in this experiment the dual- structure filter could decrease the CO/tar ratio while maintaining the tar amount and the PAPR when the PD ratio was 2.8, i.e., when the air-permeation resistance per unit length of the first filter element on the upstream side of the filter was significantly lower than that of the second filter element on the foot side.

Being able to maintain the tar amount means that the tar amount can be maintained within the range of±1 mg with respect to the tar amount in the control. Also, being able to maintain the product air-permeation resistance means that the product air-permeation resistance can be maintained within the range of ±10 $mmH_2O$ with respect to the product air-permeation resistance of the control.

In the above experiment, a comparison of the actually measured values and the calculated values reveals that the filter characteristics prediction using the simulation described earlier was appropriate.

The present invention can maintain the PAPR as described above, and this has the following implication. That is, the taste of a cigarette differs from one brand to another, so different brands have different taste images. This taste image of each brand is affected not only by the materials of the wrapping paper and filter and the types of flavors and tobacco materials but also by the product air-permeation resistance (PAPR). Therefore, to keep the taste images of individual cigarettes unchanged, being able to maintain the PAPR is crucial in cigarettes.

Whether two conditions (to be referred to as objective conditions hereinafter), i.e., being able to decrease the CO/tar ratio to less than 1 and being able to maintain the PAPR can be simultaneously achieved was checked.

First, as can be seen from FIG. 3A, for the same Vf, the cigarette using plain filter 1 having a low FAPR (closed) has a lower CO/tar ratio than that of the cigarette using plain filter 2 having a high FAPR (closed). However, the PAPR of the latter cigarette also lowers as shown in FIG. 3B. That is, when a plain filter is used, the CO/tar ratio can be decreased by decreasing the FAPR (closed). However, the flavor and taste unavoidably deteriorate due to a decrease in the PAPR. As shown in FIG. 3A, in the cigarette using a filter having a low FAPR (closed), the CO/tar ratio can be decreased to less than 1 if Vf is 53% or more. If this is the case, however, the PAPR is less than 90 $mmH_2O$ as shown in FIG. 3B. As already explained, the PAPR is preferably 90 to 130 $mmH_2O$ in respect of the flavor and taste. Unfortunately, the above objective conditions could not be achieved by the method of decreasing the CO/tar ratio by decreasing the FAPR (closed) of a plain filter.

On the other hand, as is apparent from FIGS. 4A, 4B, 5A, and 5B, the cigarettes with a dual-structure filter having a PD ratio of 2.8 according to the present invention could decrease the CO/tar ratio to less than 1 and maintain the PAPR within the range of 90 to 130 $mmH_2O$ when Vf was 53% or more.

Cases wherein the FAPR (closed) of the dual-structure filter according to the present invention was changed will be described below.

Figure 6A:
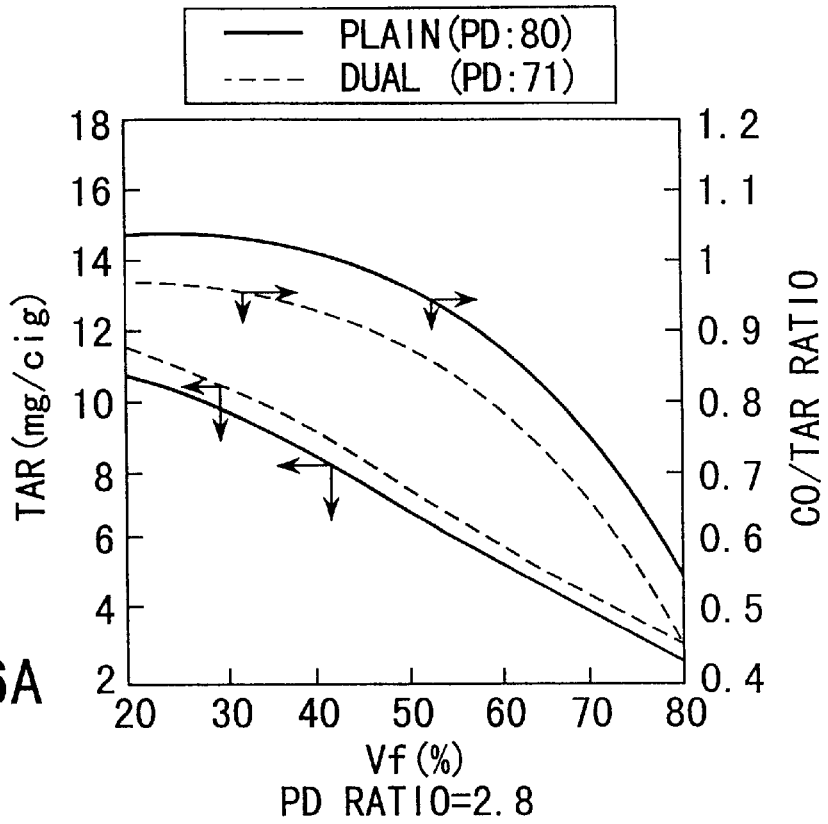
FIG. 6A is a graph showing the tar amount per cigarette and the CO/tar ratio as functions of Vf in a plane filter cigarette (PD=80 $mmH_2O$) as a comparative example and a dual-structure filter cigarette (PD=71 $mmH_2O$, PD ratio=2.8) according to the present invention.

FIG. 6A shows the tar amount per cigarette and the CO/tar ratio as functions of Vf (%) in a cigarette using a plain filter having an FAPR (closed) of 80 $mmH_2O$ and a cigarette using a dual-structure filter having an FAPR (closed) as a whole of 71 $mmH_2O$ and a PD ratio of 2.8.

Figure 6B:
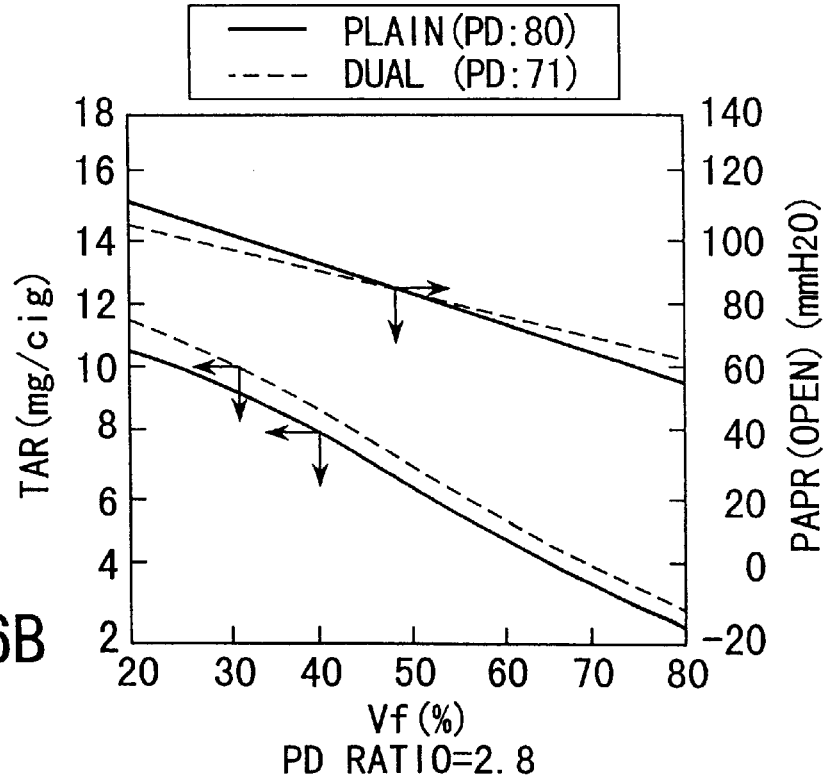
FIG. 6B is a graph showing the tar amount per cigarette and the product air-permeation resistance as functions of Vf (%) in the cigarettes shown in FIG. 6A.

FIG. 6B shows the tar amount per cigarette and the PAPR as functions of Vf (%) in cigarettes using the same filters as in FIG. 6A.

Referring to FIGS. 6A and 6B, the solid and broken lines indicate values calculated by simulation for these cigarettes.

As shown in FIGS. 6A and 6B, the cigarette using a dual-structure filter having an FAPR (closed) of 71 $mmH_2O$ as a whole and a PD ratio of 2.8 could achieve the objective conditions when Vf was 40% or less.

Figure 7A:
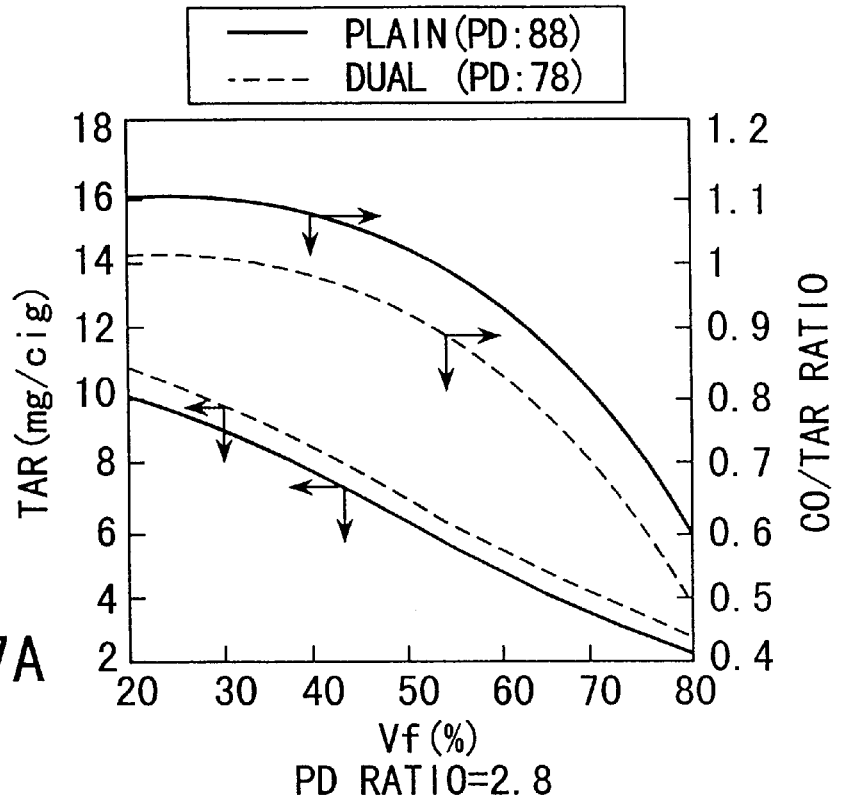
FIG. 7A is a graph showing the tar amount per cigarette and the CO/tar ratio as functions of Vf in a plane filter cigarette (PD=88 $mmH_2O$) as a comparative example and a dual-structure filter cigarette (PD=78 $mmH_2O$, PD ratio=2.8) according to the present invention.

FIG. 7A shows the tar amount per cigarette and the CO/tar ratio as functions of Vf (%) in a cigarette using a plain filter having an FAPR (closed) of 88 $mmH_2O$ and a cigarette using a dual-structure filter having an FAPR (closed) as a whole of 78 $mmH_2O$ and a PD ratio of 2.8.

Figure 7B:
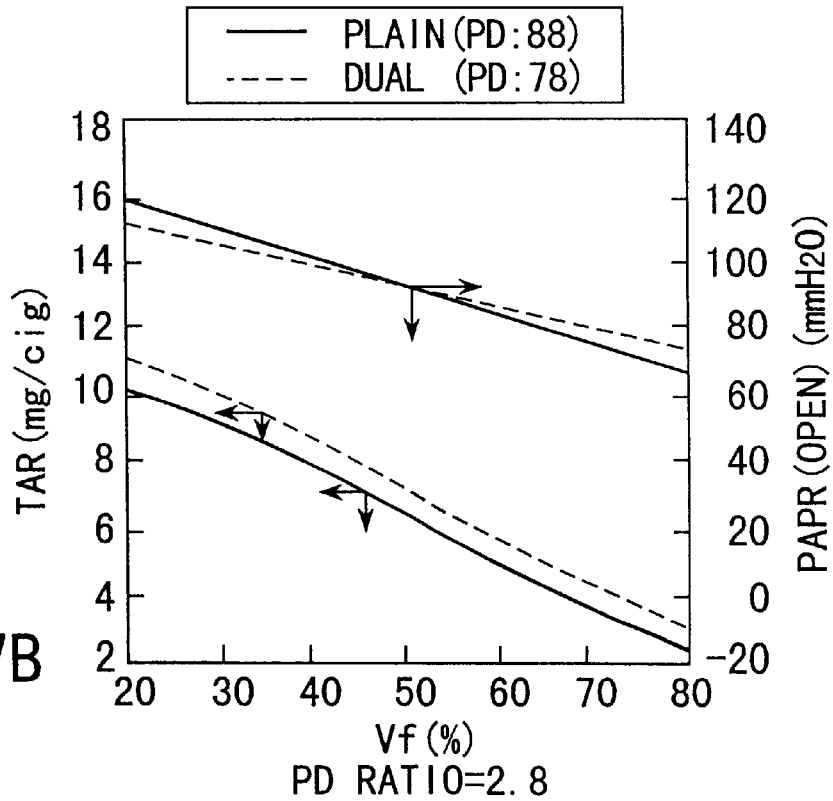
FIG. 7B is a graph showing the tar amount per cigarette and the product air-permeation resistance as functions of Vf (%) in the cigarettes shown in FIG. 7A.

FIG. 7B shows the tar amount per cigarette and the PAPR as functions of Vf (%) in cigarettes using the same filters.

Referring to FIGS. 7A and 7B, the solid and broken lines indicate values calculated by simulation for these cigarettes.

As shown in FIGS. 7A and 7B, the cigarette using a dual-structure filter having an FAPR (closed) of 78 $mmH_2O$ as a whole and a PD ratio of 2.8 could achieve the objective conditions when Vf was 35 to 50%.

Figure 8A:
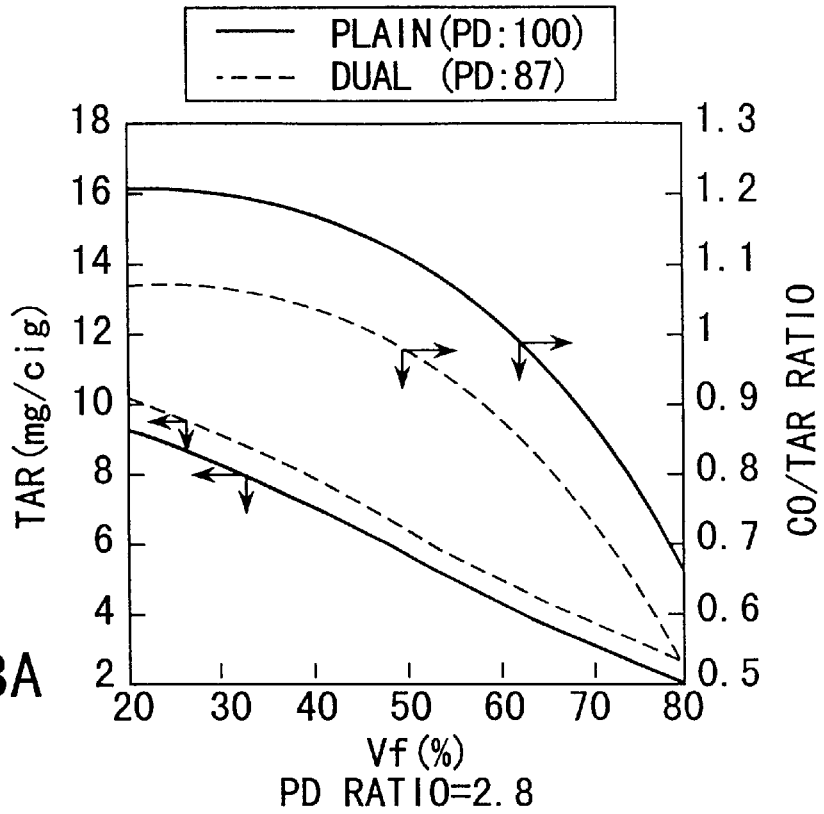
FIG. 8A is a graph showing the tar amount per cigarette and the CO/tar ratio as functions of Vf in a plane filter cigarette (PD=100 $mmH_2O$) as a comparative example and a dual-structure filter cigarette (PD=87 $mmH_2O$, PD ratio=2.8) according to the present invention.

FIG. 8A shows the tar amount per cigarette and the CO/tar ratio as functions of Vf (%) in a cigarette using a plain filter having an FAPR (closed) of 100 $mmH_2O$ and a cigarette using a dual-structure filter having an FAPR (closed) of 87 $mmH_2O$ as a whole and a PD ratio of 2.8.

Figure 8B:
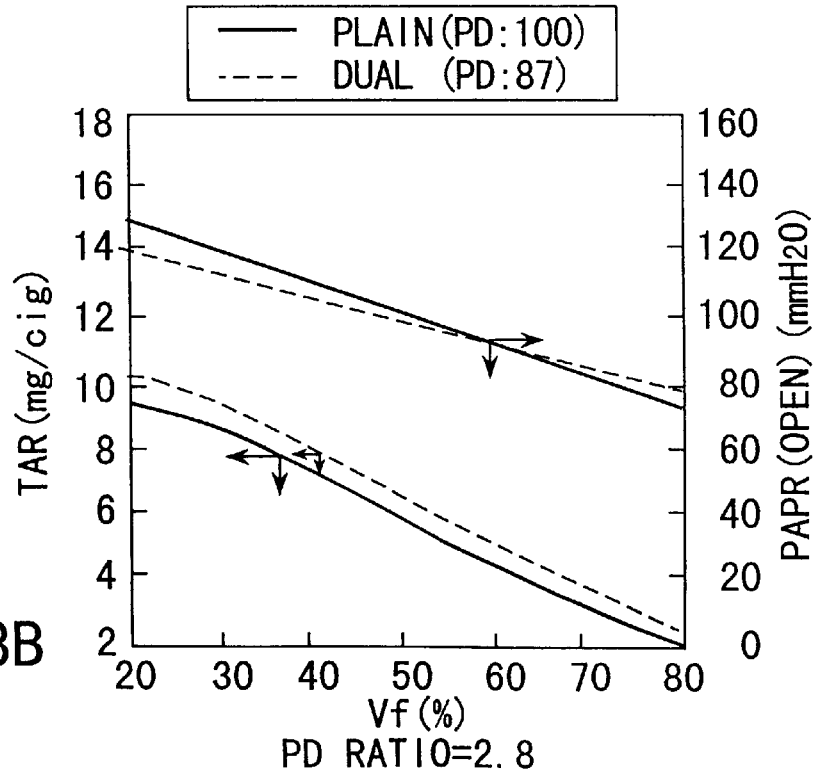
FIG. 8B is a graph showing the tar amount per cigarette and the product air-permeation resistance as functions of Vf (%) in the cigarettes shown in FIG. 8A.

FIG. 8B shows the tar amount per cigarette and the PAPR as functions of Vf (%) in cigarettes using the same filters as in FIG. 8A.

Referring to FIGS. 8A and 8B, the solid and broken lines indicate values calculated by simulation for these cigarettes.

As shown in FIGS. 8A and 8B, the cigarette using a dual-structure filter having an FAPR (closed) of 87 $mmH_2O$ as a whole and a PD ratio of 2.8 could achieve the objective conditions when Vf was 48 to 60%.

Figure 9A:
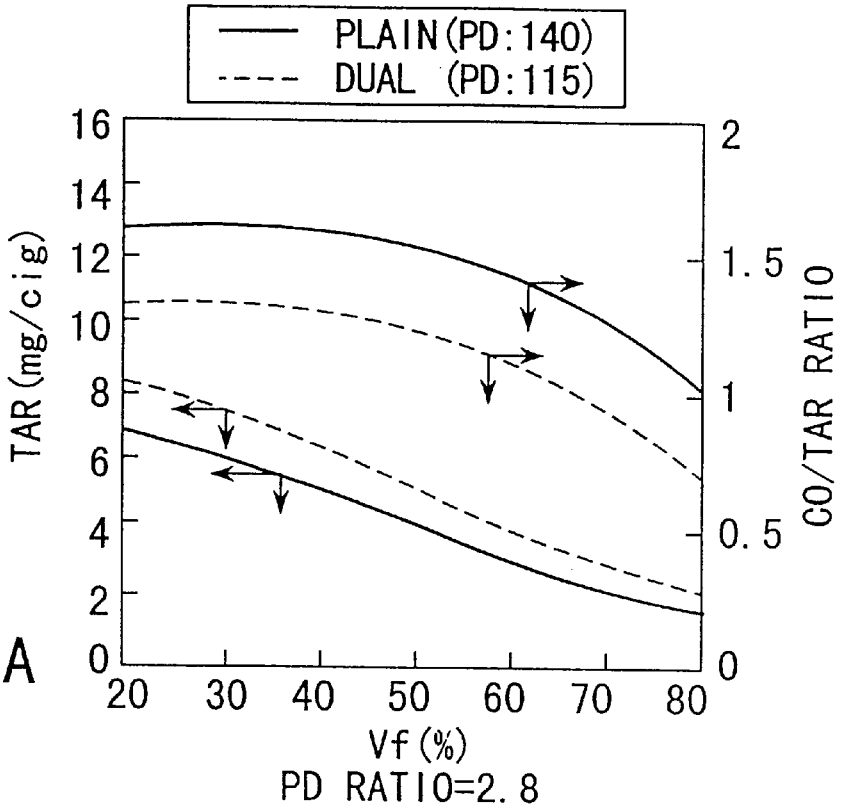
FIG. 9A is a graph showing the tar amount per cigarette and the CO/tar ratio as functions of Vf in a plane filter cigarette (PD=140 $mmH_2O$) as a comparative example and a dual-structure filter cigarette (PD=115 $mmH_2O$, PD ratio=2.8) according to the present invention.

FIG. 9A shows the tar amount per cigarette and the CO/tar ratio as functions of Vf (%) in a cigarette using a plain filter having an FAPR (closed) of 140 $mmH_2O$ and a cigarette using a dual-structure filter having an FAPR (closed) as a whole of 115 $mmH_2O$ and a PD ratio of 2.8.

Figure 9B:
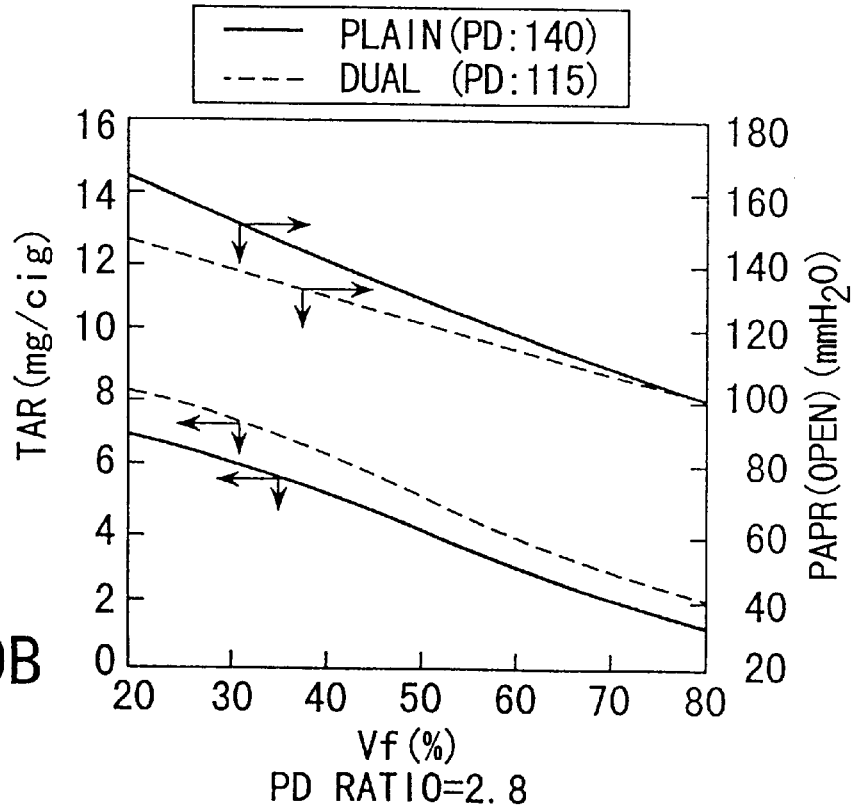
FIG. 9B is a graph showing the tar amount per cigarette and the product air-permeation resistance as functions of Vf (%) in the cigarettes shown in FIG. 9A.

FIG. 9B shows the tar amount per cigarette and the PAPR as functions of Vf (%) in cigarettes using the same filters as in FIG. 9A.

Referring to FIGS. 9A and 9B, the solid and broken lines indicate values calculated by simulation for these cigarettes.

As shown in FIGS. 9A and 9B, the cigarette using a dual-structure filter having an FAPR (closed) of 115 $mmH_2O$ as a whole and a PD ratio of 2.8 could achieve the objective conditions when Vf was 66% or more.

Simulation was performed in the same manner as above to check the effects that the filter air-permeation resistance, tar-filtering efficiency, PD ratio, opening position, Vf, and filter element length had on the characteristics such as the PAPR and CO/tar ratio of a cigarette.

(i) Filter element PD ratio

Figure 10:
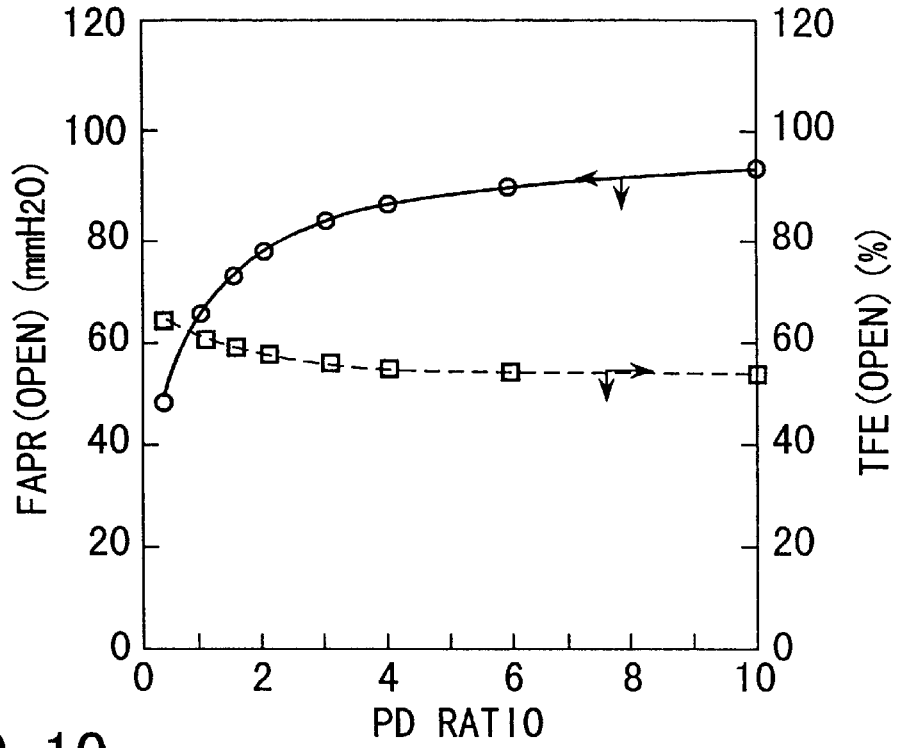
FIG. 10 is a graph showing the filter air-permeation resistance (open) and the filter tar-filtering efficiency (open) as functions of the PD ratio of a dual-structure filter (filter air-permeation resistance (closed)=100 $mmH_2O$, Vf=70%)

FIG. 10 is a graph showing the characteristics of a dual-structure filter with ventilation holes not closed, i.e., the FAPR (open) and the tar-filtering efficiency (open) of the filter as functions of the PD ratio of the filter. The tar-filtering efficiency (open) is the tar-filtering efficiency when ventilation holes formed in the tip paper are not closed, and is abbreviated as TFE (open). In this case, a FAPR (closed) was 100 $mmH_2O$, a filter length was 25 mm, a first filter element length was 12.5 mm, a second filter element length was 12.5 mm, Vf was 70%, ZC was 12.5 mm, a tobacco rod CO/tar ratio was 0.60, and a tobacco rod air-permeation resistance was 47 $mmH_2O$. A PD ratio of 1 corresponds to a plain filter.

As shown in FIG. 10, as the PD ratio was increased, the FAPR (open) increased, and the TFE (open) slightly decreased.

Figure 11:
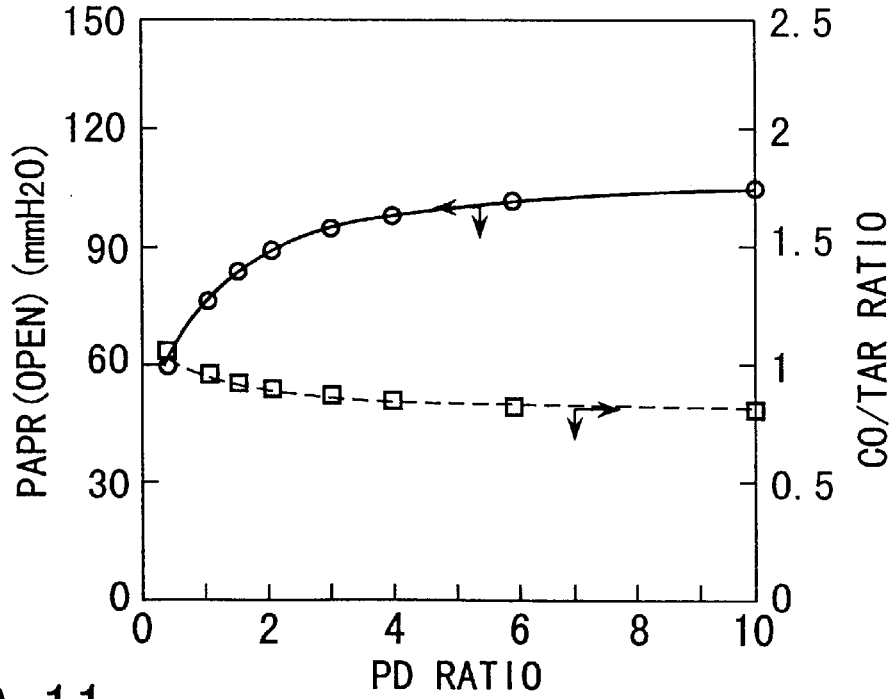
FIG. 11 is a graph showing the product air-permeation resistance and the CO/tar ratio as functions of the PD ratio of a dual-structure filter (filter air-permeation resistance (closed)=100 $mmH_2O$, Vf=70%)

FIG. 11 is a graph showing the PAPR and the CO/tar ratio as functions of the PD ratio of a dual-structure filter under the same conditions as in FIG. 10. As shown in FIG. 11, under the above conditions the CO/tar ratio was less than 1.0 and the PAPR was 90 to 130 $mmH_2O$ when the PD ratio was 2 or more.

In the case shown in FIG. 10, Vf was changed from 70% to 30%, and the FAPR (closed) was changed from 100 to 65 $mmH_2O$. The results are shown FIG. 12.

Similarly, in the case shown in FIG. 11, Vf was changed from 70% to 30%, and the FAPR (closed) was changed from 100 to 65 $mmH_2O$. The results are shown in FIG. 13.

Figure 12:
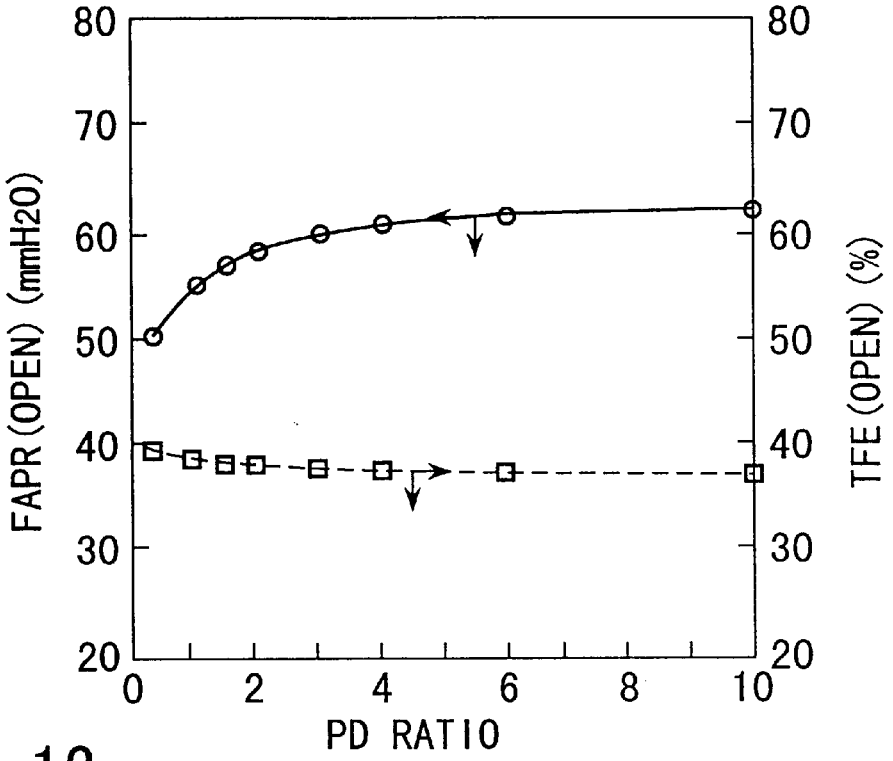
FIG. 12 is a graph showing the filter air-permeation resistance (open) and the filter tar-filtering efficiency (open) as functions of the PD ratio of a dual-structure filter (filter air-permeation resistance (closed)=65 $mmH_2O$, Vf=30%)
Figure 13:
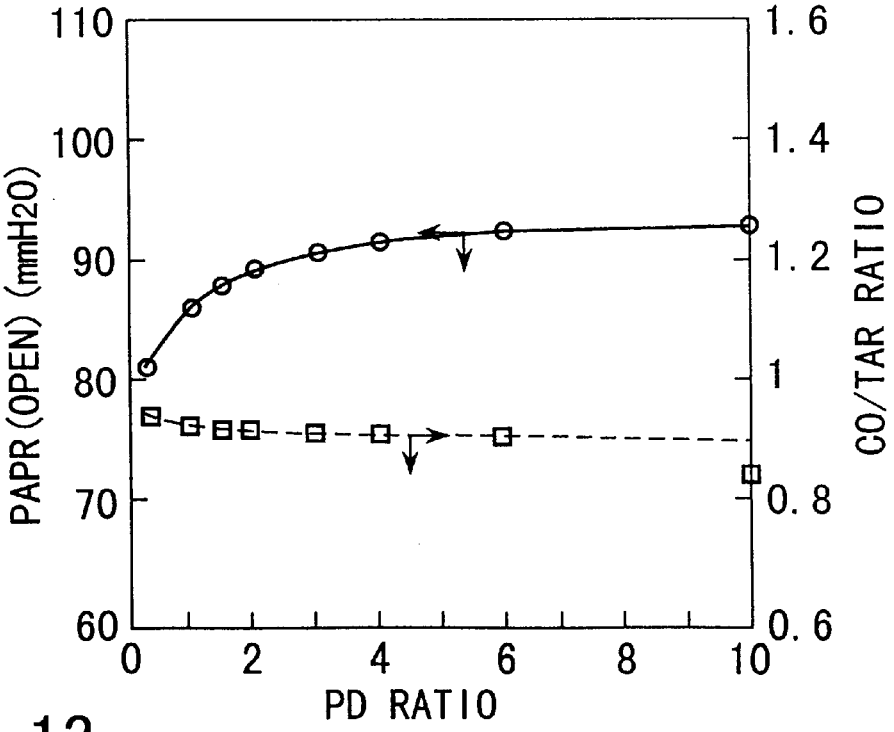
FIG. 13 is a graph showing the product air-permeation resistance and the CO/tar ratio as functions of the PD ratio of a dual-structure filter (filter air-permeation resistance (closed)=65 $mmH_2O$, Vf=30%)

As shown in FIGS. 12 and 13, the cigarette with a dual-structure filter could achieve the objective conditions when the PD ration was 2.5 or more if Vf was 30% and the FAPR (closed) was 65 $mmH_2O$.

(ii) Opening position

Figure 14:
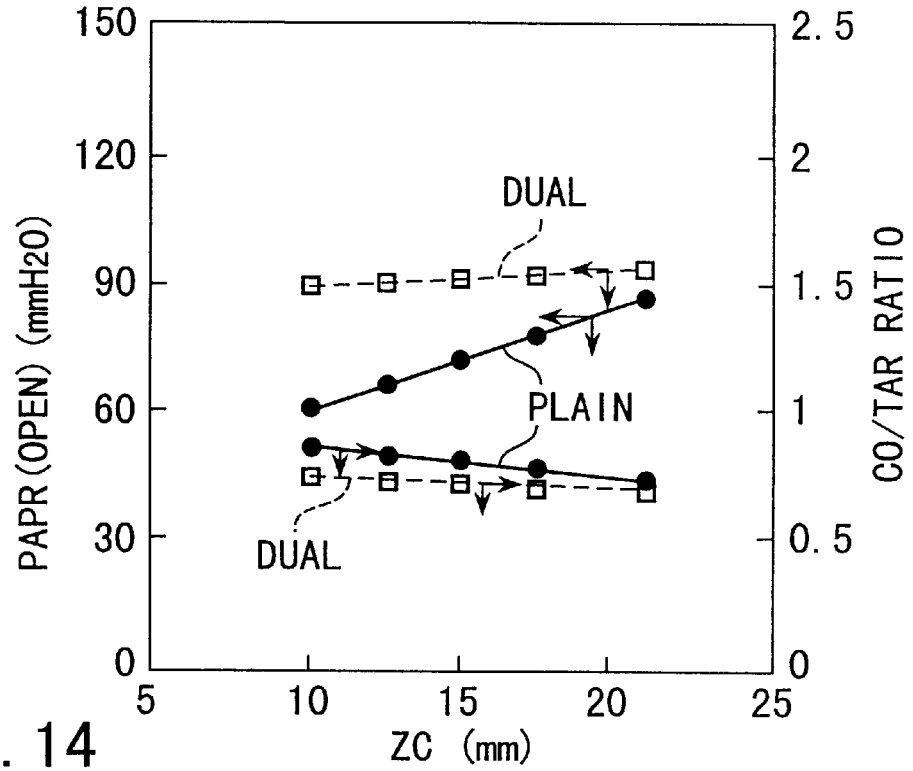
FIG. 14 is a graph showing the product air-permeation resistance and the CO/tar ratio as functions of the opening position in a tip paper.

FIG. 14 is a graph showing the PAPR and the CO/tar ratio as functions of the opening position in a tip paper. ZC is the distance from the foot end of the filter to the opening position. In this case, a filter length was 25 mm, a FAPR (closed) was 90 $mmH_2O$, Vf was 70%, a PD ratio was 6, a first filter element length was 15 mm, a second filter element length was 10 mm, a tobacco rod CO/tar ratio was 0.60, and a tobacco rod air-permeation resistance was 47 $mmH_2O$. For comparison, the results of a plain filter are also shown.

As shown in FIG. 14, a dual-structure filter in which the opening position was preferable, i.e., ZC was 10 to 21 mm or ranged between 4 mm or more from the upstream end of the filter and 10 mm from the foot end of the filter in this simulation and the PD ratio was 6 could decrease the CO/tar ratio to less than 1.0 and increase the PAPR to 90 $mmH_2O$ or more. The PAPR of this filter was significantly different from that of the plain filter. In particular, the CO/tar ratio could be decreased as the ZC value was increased.

Figure 15:
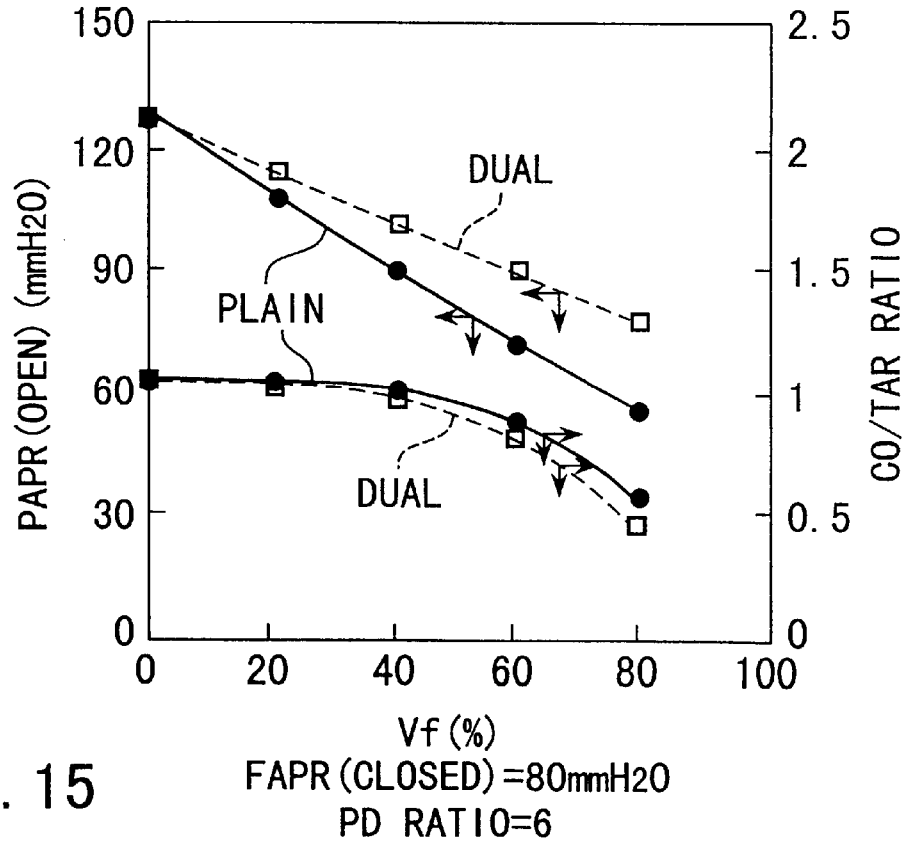
FIG. 15 is a graph showing the product air-permeation resistance and the CO/tar ratio as functions of Vf in a dual-structure filter (filter air-permeation resistance (closed)=80 $mmH_2O$, PD ratio=6) of the present invention.
Figure 16:
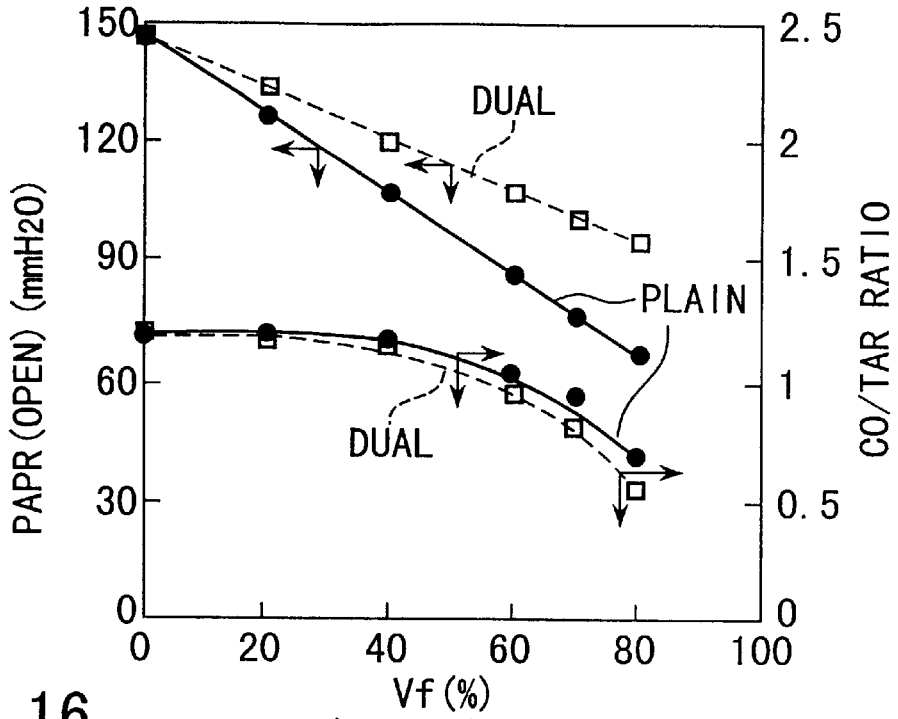
FIG. 16 is a graph showing the product air-permeation resistance and the CO/tar ratio as functions of Vf in a dual-structure filter (filter air-permeation resistance (closed)=100 $mmH_2O$, PD ratio=6) of the present invention.

(iii) Vf The PAPR and the CO/tar ratio as functions of Vf when the FAPR (closed) was 80 and 100 $mmH_2O$ were checked. The results are shown in FIGS. 15 and 16. In these cases, a filter length was 25 mm, ZC was 12.5 mm, a PD ratio was 6, a first filter element length was 12.5 mm, a second filter element length was 12.5 mm, a tobacco rod CO/tar ratio was 0.60, and a tobacco rod air-permeation resistance was 47 $mmH_2O$. For comparison, the results of a plain filter are also shown.

As shown in FIG. 15, when the FAPR (closed) was 80 $mmH_2O$ under the above conditions, decreases in the CO/tar ratio and the PAPR were significantly different from those of the plain filter when Vf was 20% or more. Especially when Vf was 35 to 60%, the CO/tar ratio dropped to less than 1.0, and the product air-permeation resistance was 90 to 130 $mmH_2O$.

Also, as shown in FIG. 16, when the FAPR (closed) was 100 $mmH_2O$ under the above conditions, decreases in the CO/tar ratio and the PAPR were significantly different from those of the plain filter when Vf was 20% or more. Especially when Vf was 60% or more, the CO/tar ratio decreased to less than 1.0, and the PAPR was 90 to 130 $mmH_2O$.

Figure 17:
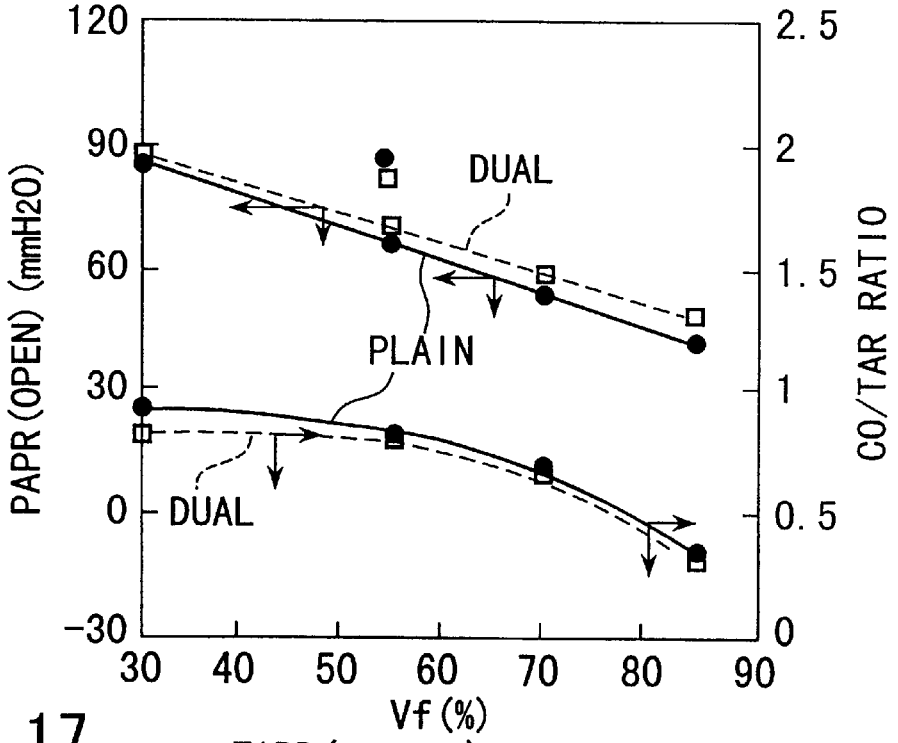
FIG. 17 is a graph showing the product air-permeation resistance and the CO/tar ratio as functions of Vf in a dual-structure filter (filter air-permeation resistance (closed)=65 $mmH_2O$, PD ratio=1.5) as a comparative example.
Figure 18:
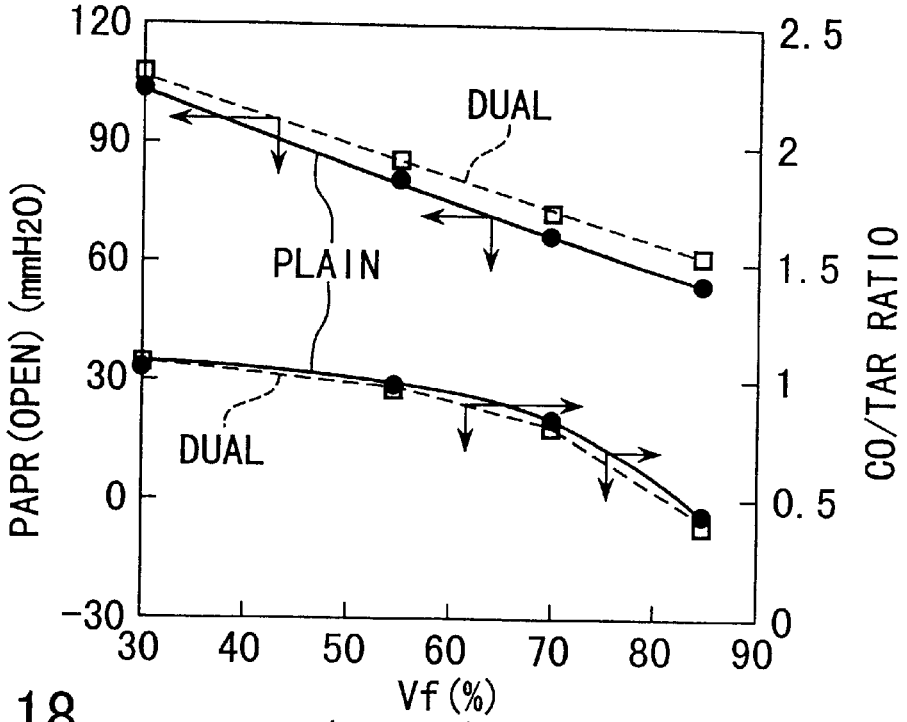
FIG. 18 is a graph showing the product air-permeation resistance and the CO/tar ratio as functions of Vf in a dual-structure filter (filter air-permeation resistance (closed)=85 $mmH_2O$, PD ratio=1.5) as a comparative example.
Figure 19:
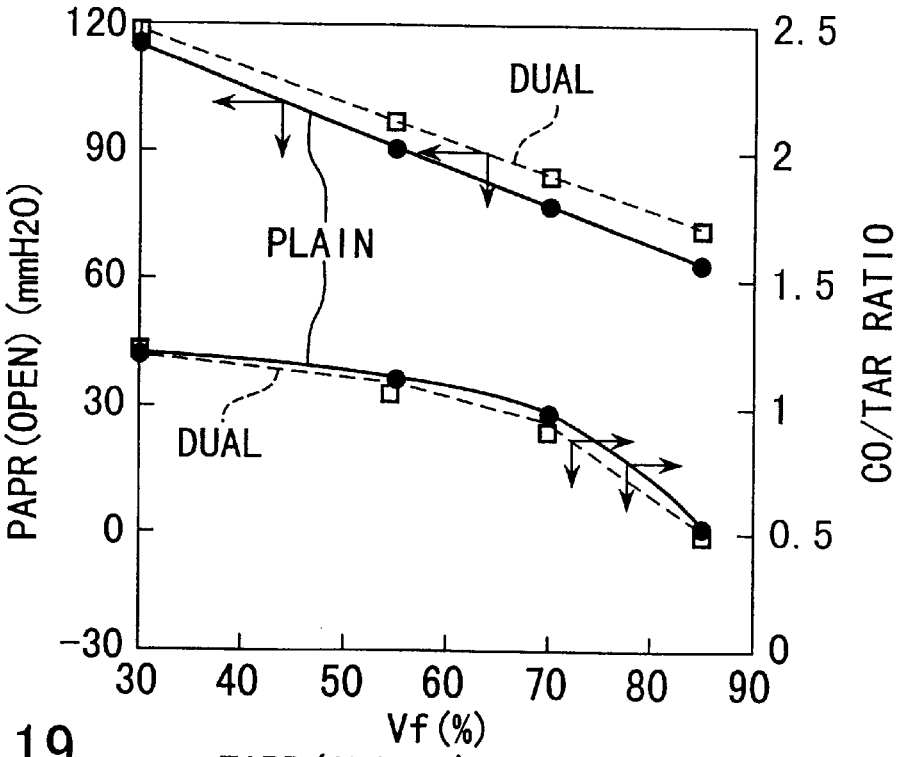
FIG. 19 is a graph showing the product air-permeation resistance and the CO/tar ratio as functions of Vf in a dual-structure filter (filter air-permeation resistance (closed)=100 $mmH_2O$, PD ratio=1.5) as a comparative example.
Figure 20:
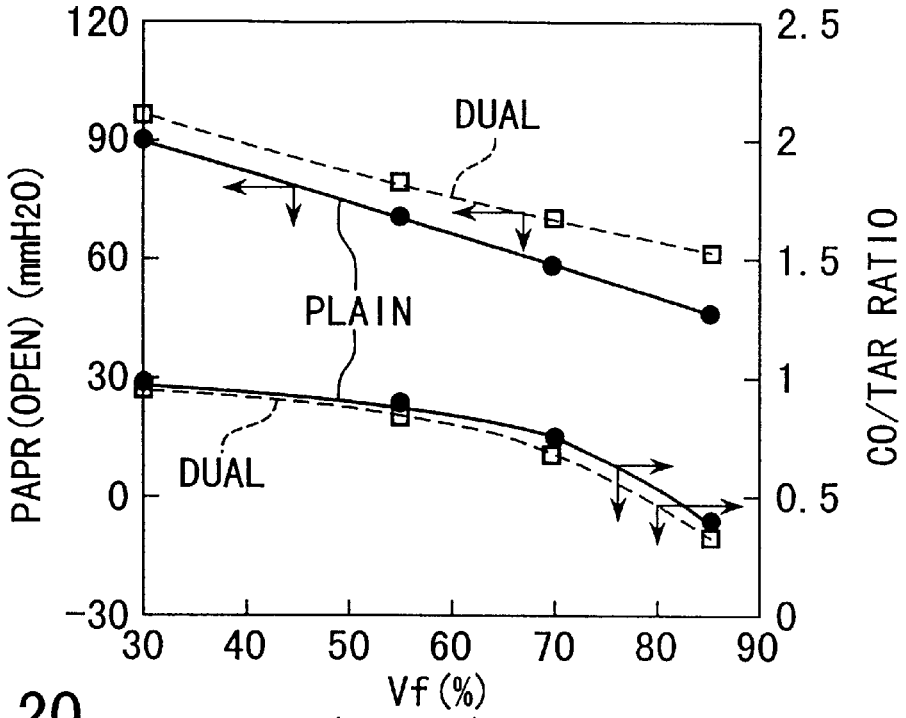
FIG. 20 is a graph showing the product air-permeation resistance and the CO/tar ratio as functions of Vf in a dual-structure filter (filter air-permeation resistance (closed)=70 $mmH_2O$, PD ratio=3) of the present invention.
Figure 21:
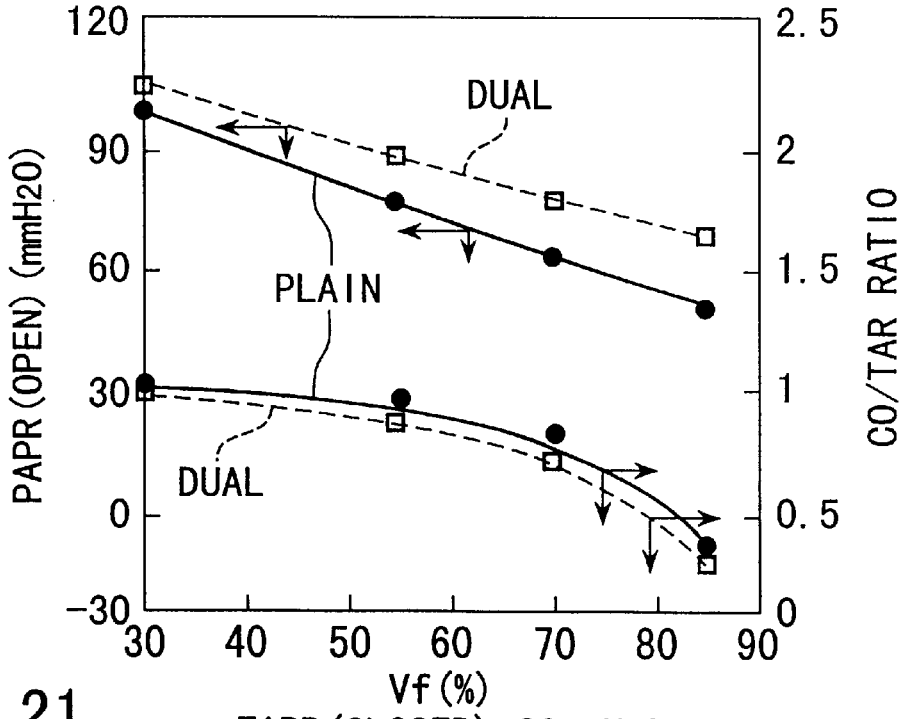
FIG. 21 is a graph showing the product air-permeation resistance and the CO/tar ratio as functions of Vf in a dual-structure filter (filter air-permeation resistance (closed)=80 $mmH_2O$, PD ratio=3) of the present invention.
Figure 22:
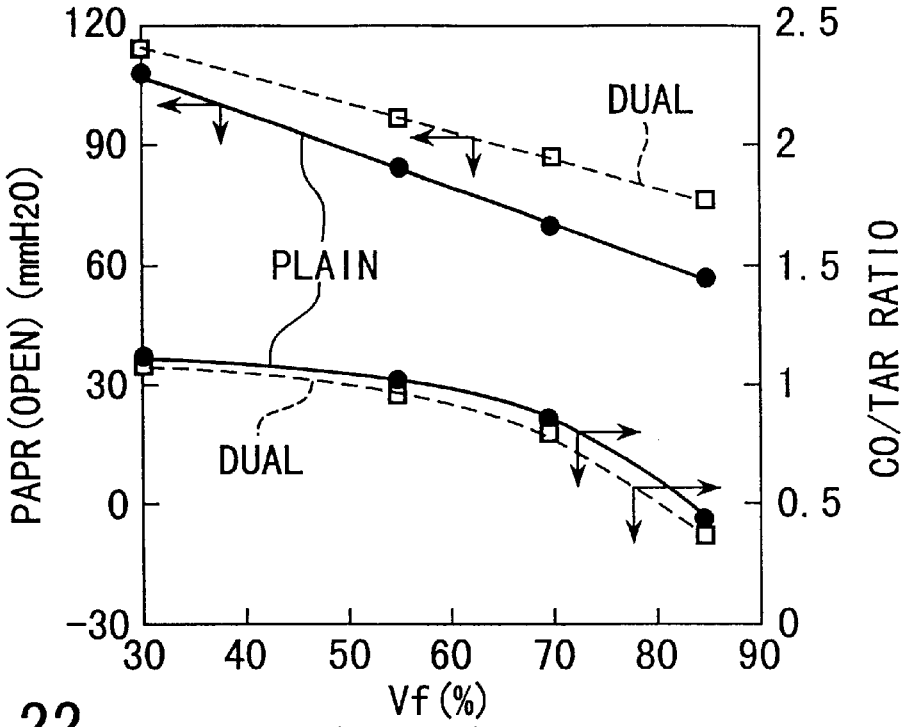
FIG. 22 is a graph showing the product air-permeation resistance and the CO/tar ratio as functions of Vf in a dual-structure filter (filter air-permeation resistance (closed)=90 $mmH_2O$, PD ratio=3) of the present invention.
Figure 23:
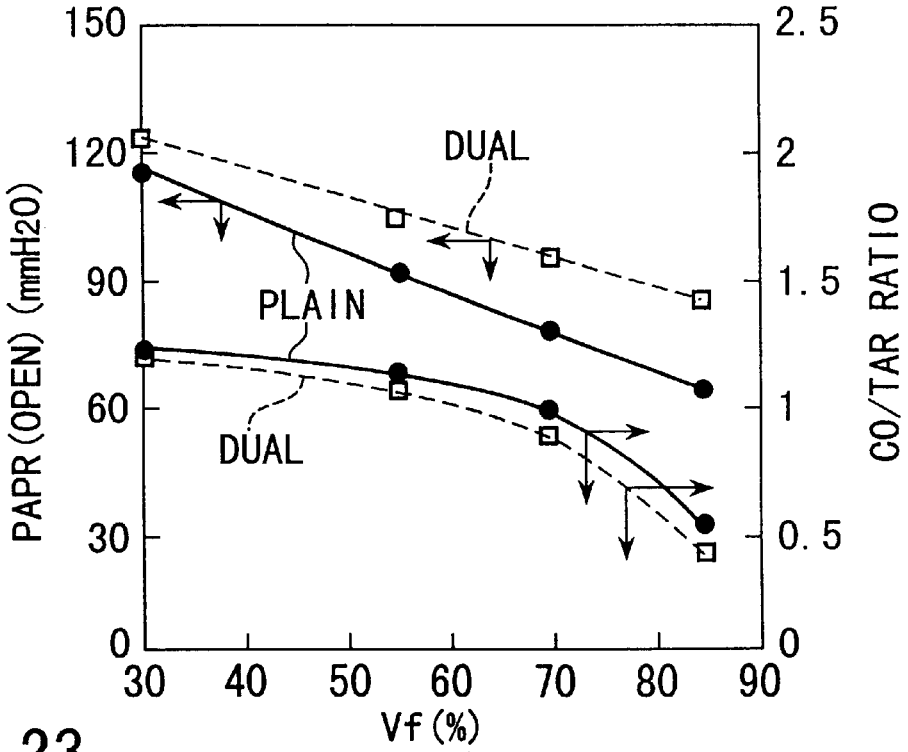
FIG. 23 is a graph showing the product air-permeation resistance and the CO/tar ratio as functions of Vf in a dual-structure filter (filter air-permeation resistance (closed)=100 $mmH_2O$, PD ratio=3) of the present invention.
Figure 24:
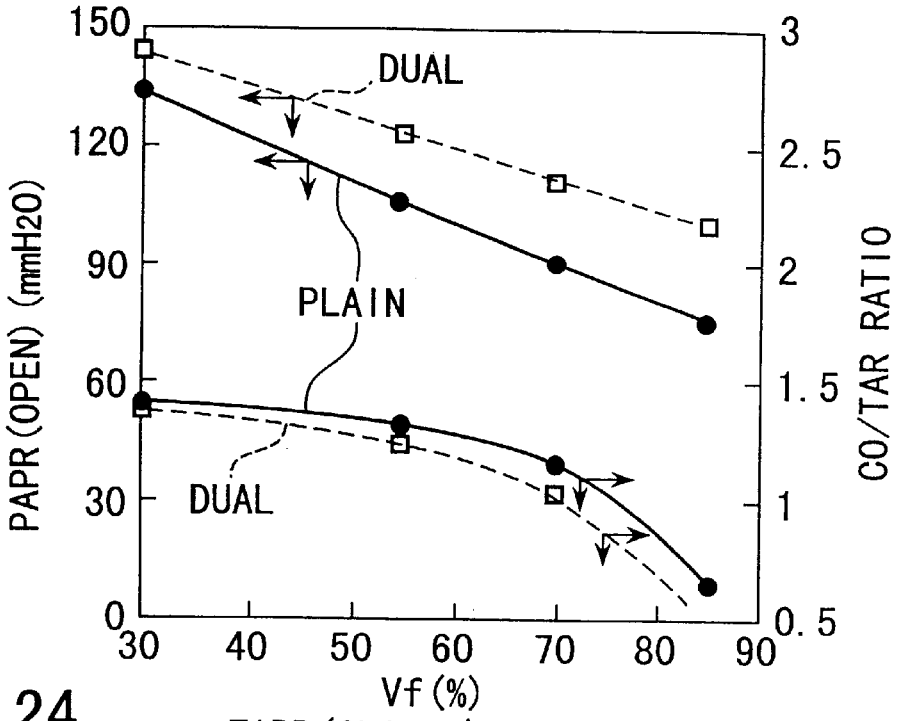
FIG. 24 is a graph showing the product air-permeation resistance and the CO/tar ratio as functions of Vf in a dual-structure filter (filter air-permeation resistance (closed)=120 $mmH_2O$, PD ratio=3) of the present invention.

As comparative examples, the PAPR and the CO/tar ratio as functions of Vf when the FAPR (closed) was 65, 85, and 100 $mmH_2O$ in a dual-structure filter having a PD ratio of 1.5 were checked. The results are shown in FIGS. 17 to 19. In these cases, a filter length was 25 mm, ZC was 12.5 mm, a PD ratio was 1.5, a first filter element length was 12.5 mm, a second filter element length was 12.5 mm, a tobacco rod CO/tar ratio was 0.60, and a tobacco rod air-permeation resistance was 47 $mmH_2O$. For comparison, the results of a plain filter are also shown.

As shown in FIGS. 17 to 19, the cigarette with a dual-structure filter having a PD ratio of 1.5 could not achieve the objective conditions regardless of whether the FAPR (closed) was 65 or 85 $mmH_2O$.

Also, the PAPR and the CO/tar ratio as functions of Vf when the FAPR (closed) was 70, 80, 90, and 100 $mmH_2O$ in a dual-structure filter having a PD ratio of 3 were checked. The results are shown in FIGS. 20 to 24. In these cases, a filter length was 25 mm, ZC was 12.5 mm, a PD ratio was 1.5, a first filter element length was 12.5 mm, a second filter element length was 12.5 mm, a tobacco rod CO/tar ratio was 0.60, and a tobacco rod air-permeation resistance was 47 $mmH_2O$. For comparison, the results of a plain filter are also shown.

As shown in FIGS. 20 to 24, the objective conditions could be achieved within the range of Vf shown in Table 5 below for each corresponding FAPR (closed).

TABLE 5

| Filter Air-Permeation Resistance (Closed) mm $H_2O$ | Vf % | FIG. |
|---|---|---|
| 70 | 30–40 | 20 |
| 80 | 35–52 | 21 |
| 90 | 50–63 | 22 |
| 100 | 59–78 | 23 |
| 120 | 71 or more | 24 |

Figure 25:
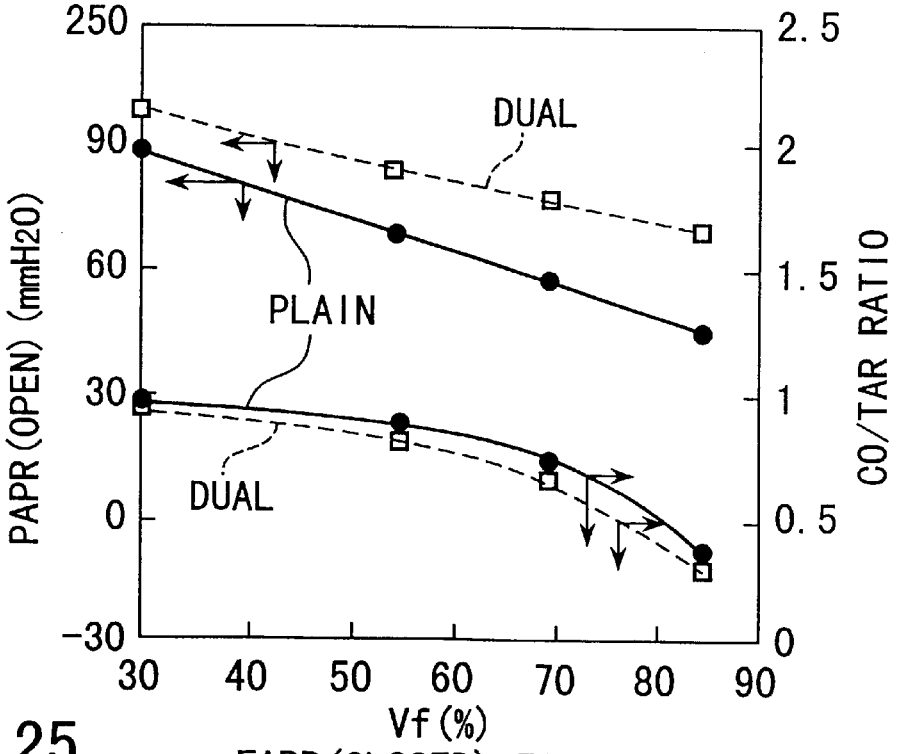
FIG. 25 is a graph showing the product air-permeation resistance and the CO/tar ratio as functions of Vf in a dual-structure filter (filter air-permeation resistance (closed)=70 $mmH_2O$, PD ratio=10) of the present invention.
Figure 26:
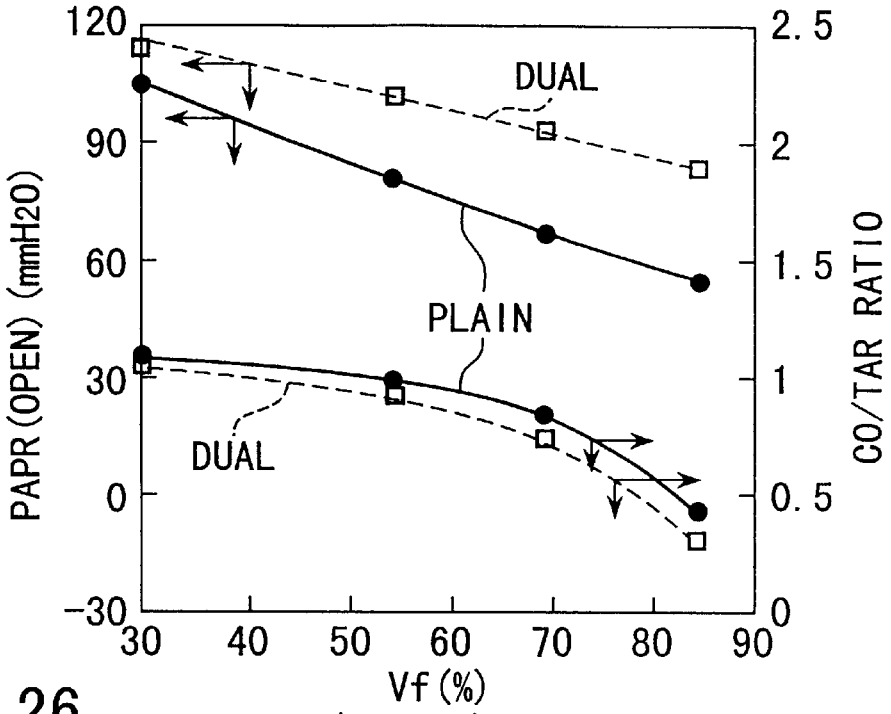
FIG. 26 is a graph showing the product air-permeation resistance and the CO/tar ratio as functions of Vf in a dual-structure filter (filter air-permeation resistance (closed)=85 $mmH_2O$, PD ratio=10) of the present invention.
Figure 27:
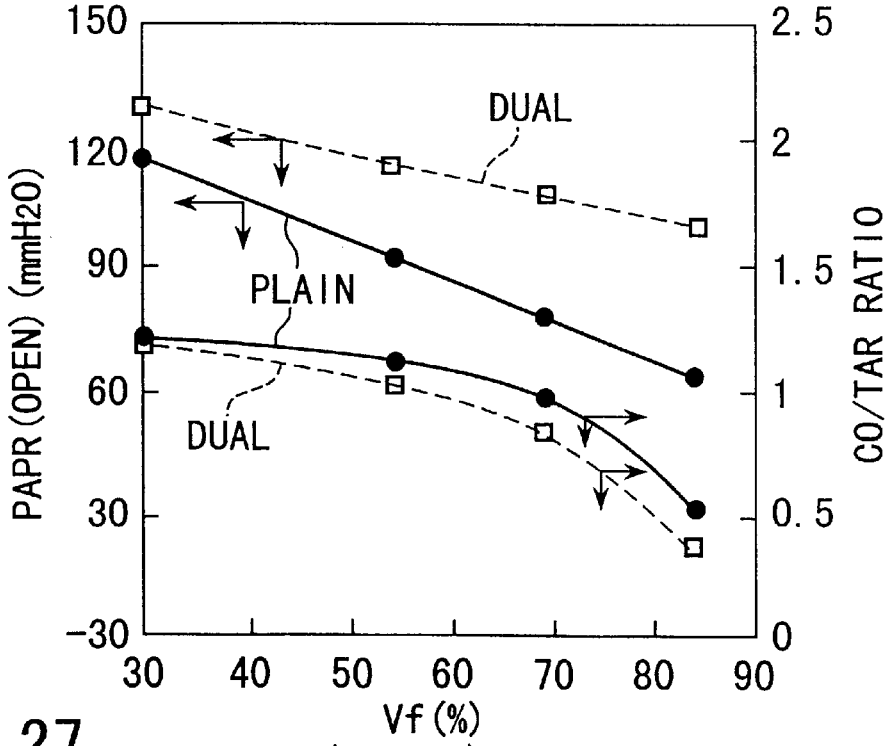
FIG. 27 is a graph showing the product air-permeation resistance and the CO/tar ratio as functions of Vf in a dual-structure filter (filter air-permeation resistance (closed)=100 $mmH_2O$, PD ratio=10) of the present invention.

Furthermore, the PAPR and the CO/tar ratio as functions of Vf when the FAPR (closed) was 70, 85, and 100 $mmH_2O$ in a dual-structure filter having a PD ratio of 10 were checked. The results are shown in FIGS. 25 to 27. In these cases, a filter length was 25 mm, ZC was 12.5 mm, a PD ratio was 1.5, a first filter element length was 12.5 mm, a second filter element length was 12.5 mm, a tobacco rod CO/tar ratio was 0.60, and a tobacco rod air-permeation resistance was 47 $mmH_2O$. For comparison, the results of a plain filter are also shown.

As shown in FIGS. 25 to 27, the objective conditions could be achieved within the range of Vf shown in Table 6 below for each corresponding FAPR (closed).

TABLE 6

| Filter Air-Permeation Resistance (Closed) mm $H_2O$ | Vf % | FIG. |
|---|---|---|
| 70 | 45 | 25 |
| 85 | 38–73 | 26 |
| 100 | 56 or more | 27 |

(iv) Filter air-permeation resistance (closed)

Figure 28:
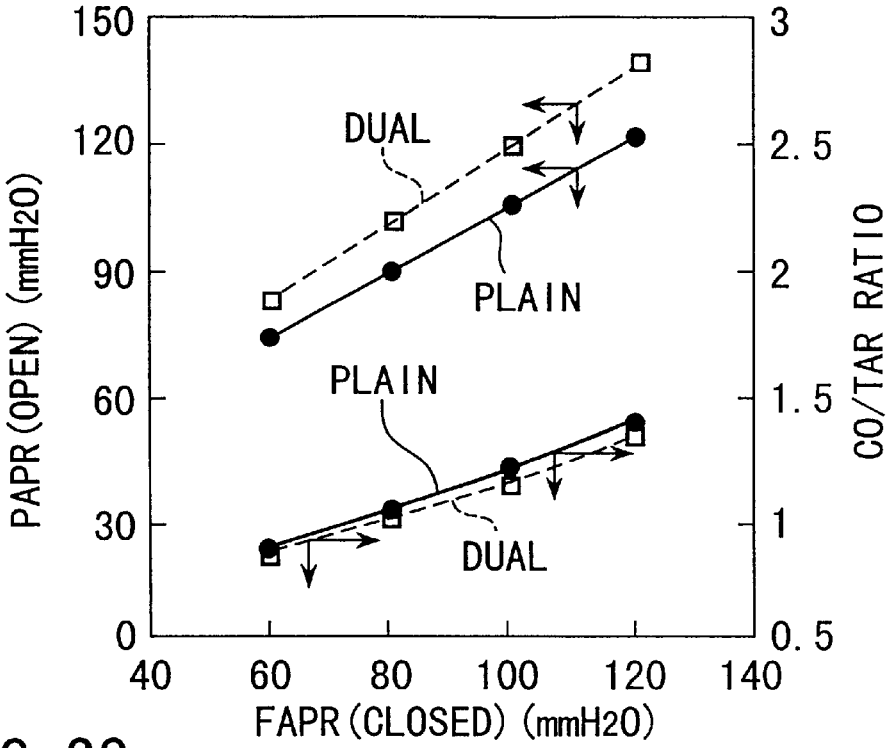
FIG. 28 is a graph showing the product air-permeation resistance and the CO/tar ratio as functions of the filter air-permeation resistance (closed) in a dual-structure filter cigarette (Vf=40%, PD ratio=6) of the present invention.
Figure 29:
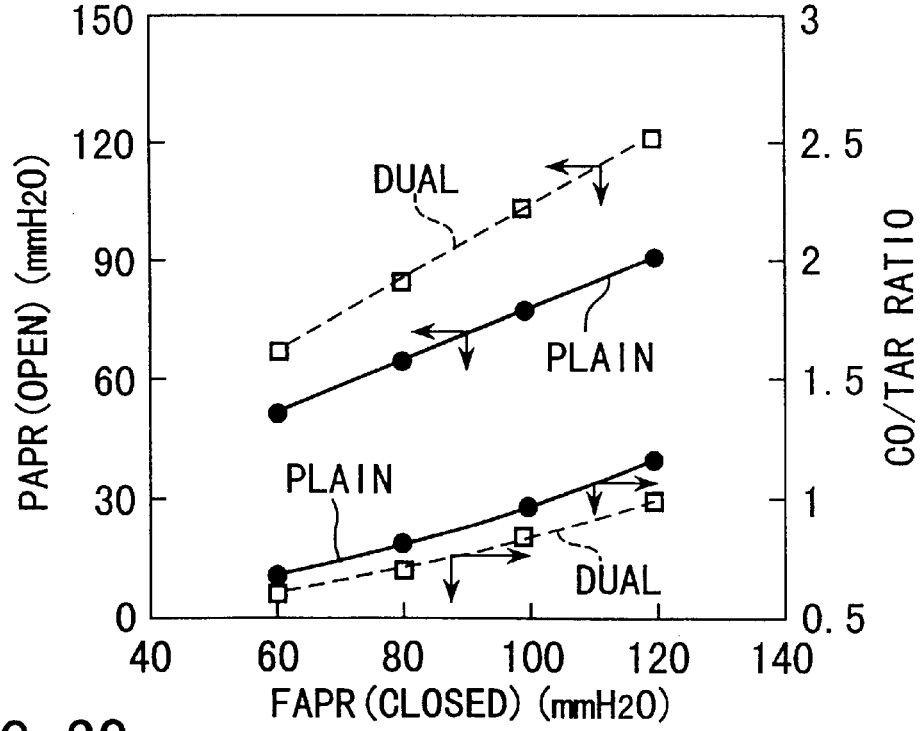
FIG. 29 is a graph showing the product air-permeation resistance and the CO/tar ratio as functions of the filter air-permeation resistance (closed) in a dual-structure filter cigarette (Vf=70%, PD ratio=6) of the present invention.

The PAPR and the CO/tar ratio as functions of the FAPR (closed) when Vf was 40% and 70% were checked. The results are shown in FIGS. 28 and 29. In these cases, a filter length was 25 mm, an opening position was 12.5 mm, a PD ratio was 6, a first filter element length was 12.5 mm, a second filter element length was 12.5 mm, a tobacco rod CO/tar ratio was 0.60, and a tobacco rod air-permeation resistance was 47 $mmH_2O$. For comparison, the results of a plain filter are also shown.

As shown in FIGS. 28 and 29, the CO/tar ratio and the PAPR of the dual-structure filter were significantly different from those of the plain filter regardless of the FAPR (closed).

In particular, when Vf was 40%, the CO/tar ratio dropped to less than 1.0 and the PAPR was 90 to 130 $mmH_2O$ if the FAPR was 65 to 80 $mmH_2O$.

Also, when Vf was 70%, the CO/tar ratio was decreased to less than 1.0 and the PAPR was 90 to 130 $mmH_2O$ if the FAPR (closed) was 85 to 120 $mmH_2O$.

Figure 30:
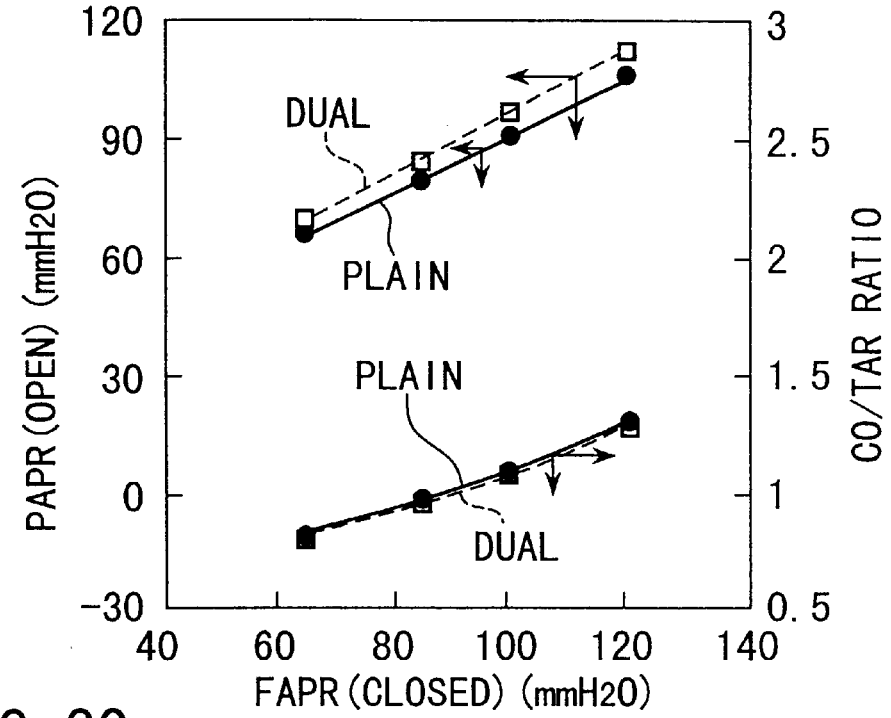
FIG. 30 is a graph showing the product air-permeation resistance and the CO/tar ratio as functions of the filter air-permeation resistance (closed) in a dual-structure filter cigarette (Vf=55%, PD ratio=1.5) as a comparative example.
Figure 31:
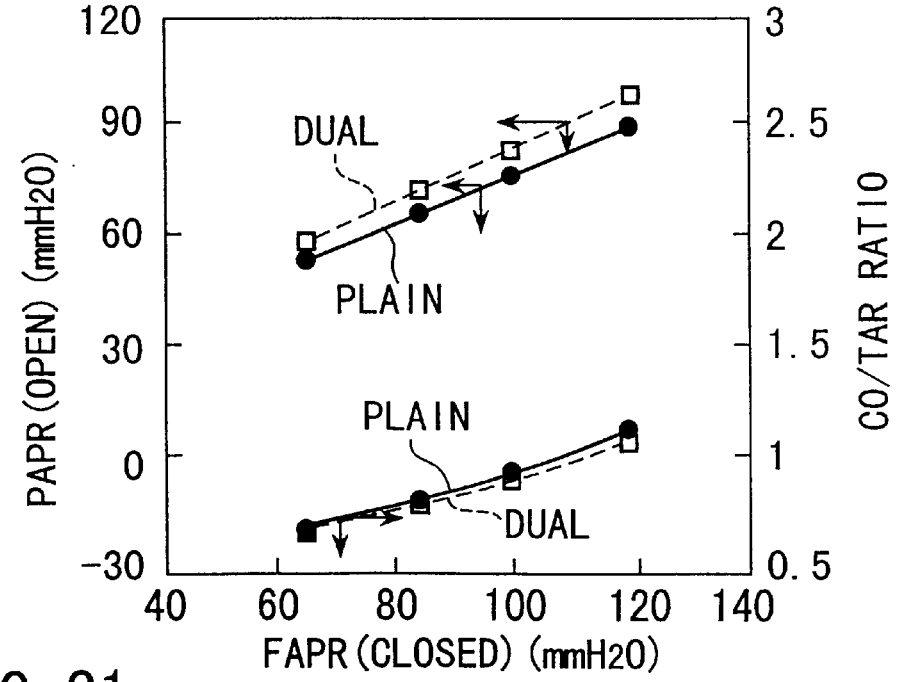
FIG. 31 is a graph showing the product air-permeation resistance and the CO/tar ratio as functions of the filter air-permeation resistance (closed) in a dual-structure filter cigarette (Vf=70%, PD ratio=1.5) as a comparative example.
Figure 32:
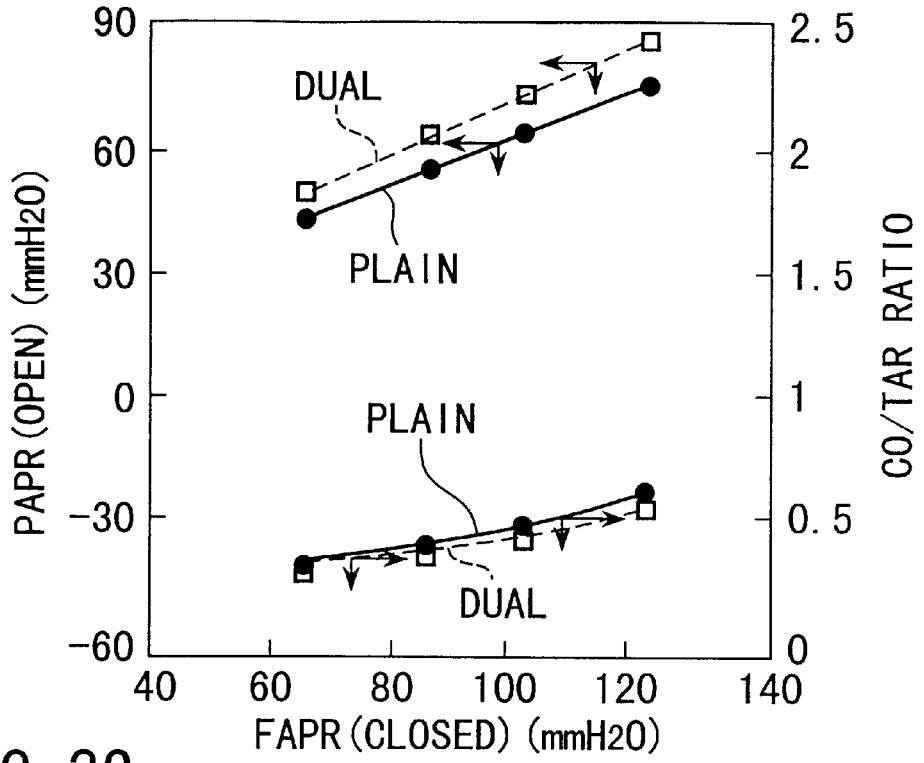
FIG. 32 is a graph showing the product air-permeation resistance and the CO/tar ratio as functions of the filter air-permeation resistance (closed) in a dual-structure filter cigarette (Vf=85%, PD ratio=1.5) as a comparative example.
Figure 33:
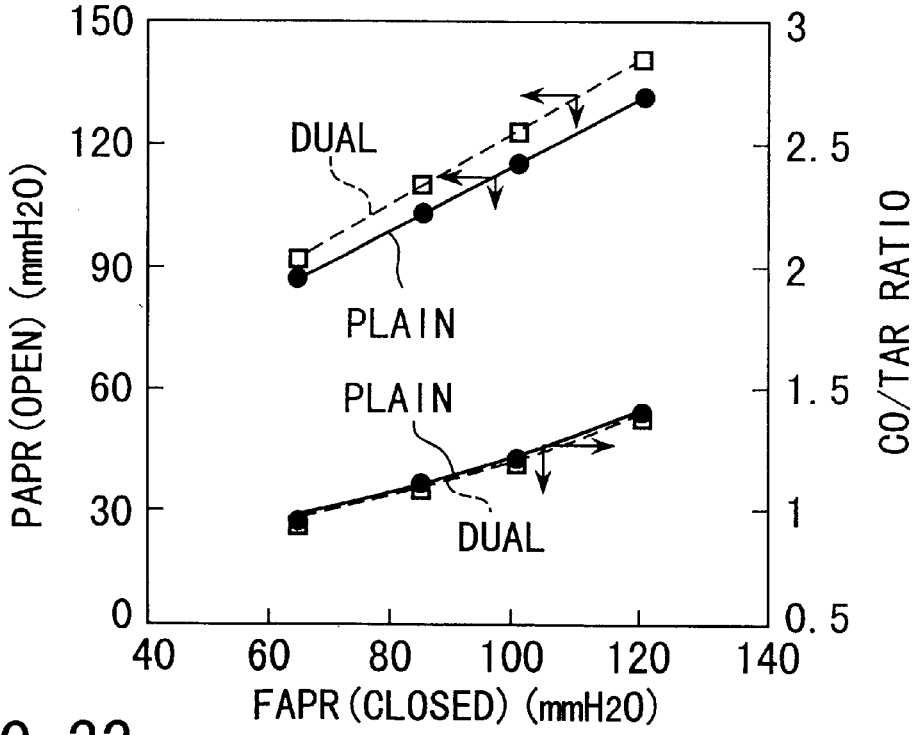
FIG. 33 is a graph showing the product air-permeation resistance and the CO/tar ratio as functions of the filter air-permeation resistance (closed) in a dual-structure filter cigarette (Vf=30%, PD ratio=3) of the present invention.
Figure 34:
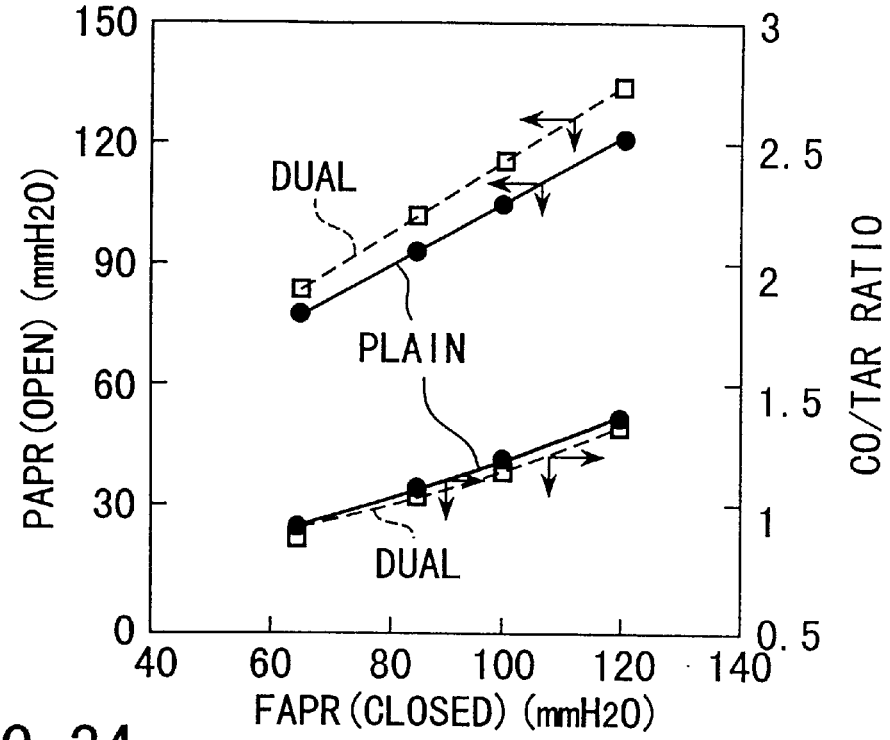
FIG. 34 is a graph showing the product air-permeation resistance and the CO/tar ratio as functions of the filter air-permeation resistance (closed) in a dual-structure filter cigarette (Vf=40%, PD ratio=3) of the present invention.
Figure 35:
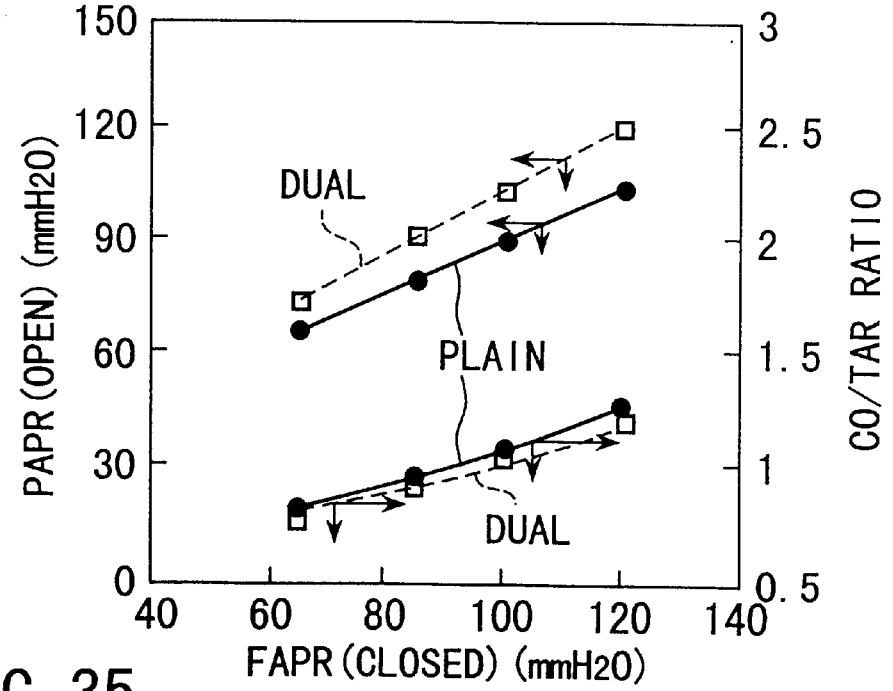
FIG. 35 is a graph showing the product air-permeation resistance and the CO/tar ratio as functions of the filter air-permeation resistance (closed) in a dual-structure filter cigarette (Vf=55%, PD ratio=3) of the present invention.
Figure 36:
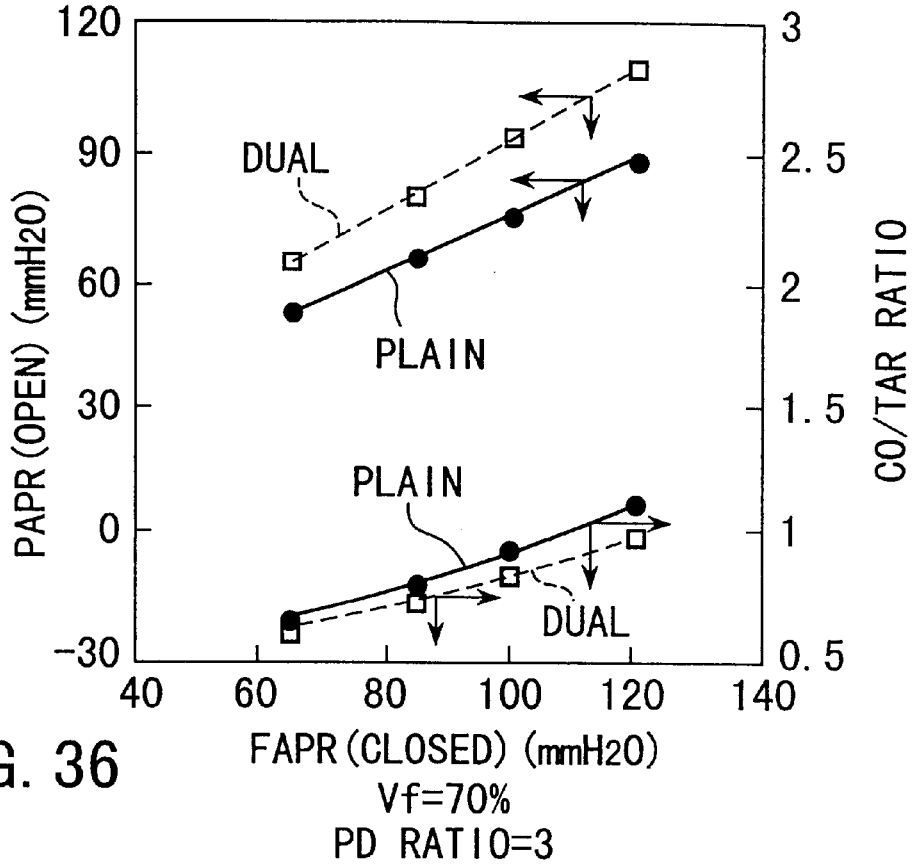
FIG. 36 is a graph showing the product air-permeation resistance and the CO/tar ratio as functions of the filter air-permeation resistance (closed) in a dual-structure filter cigarette (Vf=70%, PD ratio=3) of the present invention.
Figure 37:
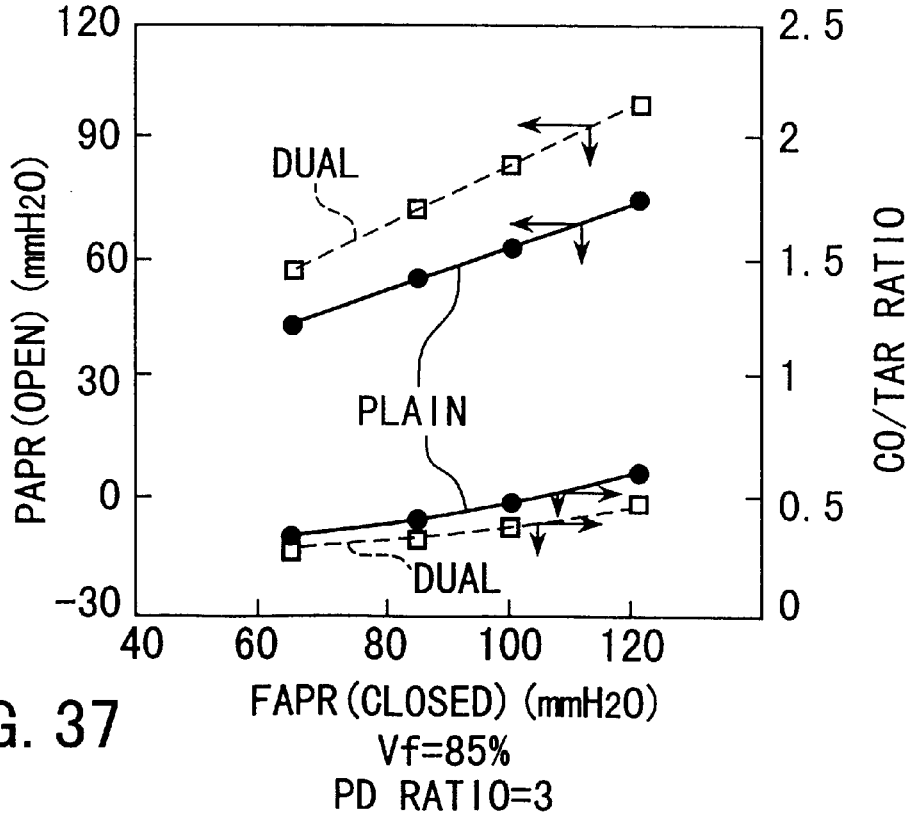
FIG. 37 is a graph showing the product air-permeation resistance and the CO/tar ratio as functions of the filter air-permeation resistance (closed) in a dual-structure filter cigarette (Vf=85%, PD ratio=3) of the present invention.

As comparative examples, the PAPR and the CO/tar ratio as functions of the FAPR (closed) when Vf was 55, 70, and 85% in a dual-structure filter having a PD ratio of 1.5 were checked. The results are shown in FIGS. 30 to 32. In these cases, a filter length was 25 mm, an opening position was 12.5 mm, a PD ratio was 1.5, a first filter element length was 12.5 mm, a second filter element length was 12.5 mm, a tobacco rod CO/tar ratio was 0.60, and a tobacco rod air-permeation resistance was 47 $mmH_2O$. For comparison, the results of a plain filter are also shown.

As shown in FIGS. 30 to 32, the cigarette with a dual-structure filter having a PD ratio of 1.5 could not achieve the objective conditions regardless of whether Vf was 55, 70, or 85%.

Also, the PAPR and the CO/tar ratio as functions of the filter air-permeation resistance (closed) when Vf was 30, 40, 55, 70, and 85% in a dual-structure filter having a PD ratio of 3 were checked. The results are shown in FIGS. 33 to 37. In these cases, a filter length was 25 mm, an opening position was 12.5 mm, a PD ratio was 3, a first filter element length was 12.5 mm, a second filter element length was 12.5 mm, a tobacco rod CO/tar ratio was 0.60, and a tobacco rod air-permeation resistance was 47 $mmH_2O$. For comparison, the results of a plain filter are also shown.

As shown in FIGS. 33 to 37, the objective conditions could be achieved within the range of FAPR (closed) shown in Table 7 below for each corresponding Vf.

TABLE 7

| Vf % | Filter Air-Permeation Resistance (Closed) mm $H_2O$ | FIG. |
|---|---|---|
| 30 | 65–75 | 33 |
| 40 | 70–82 | 34 |
| 55 | 82–93 | 35 |
| 70 | 93–116 | 36 |
| 85 | 107 or more | 37 |

Figure 38:
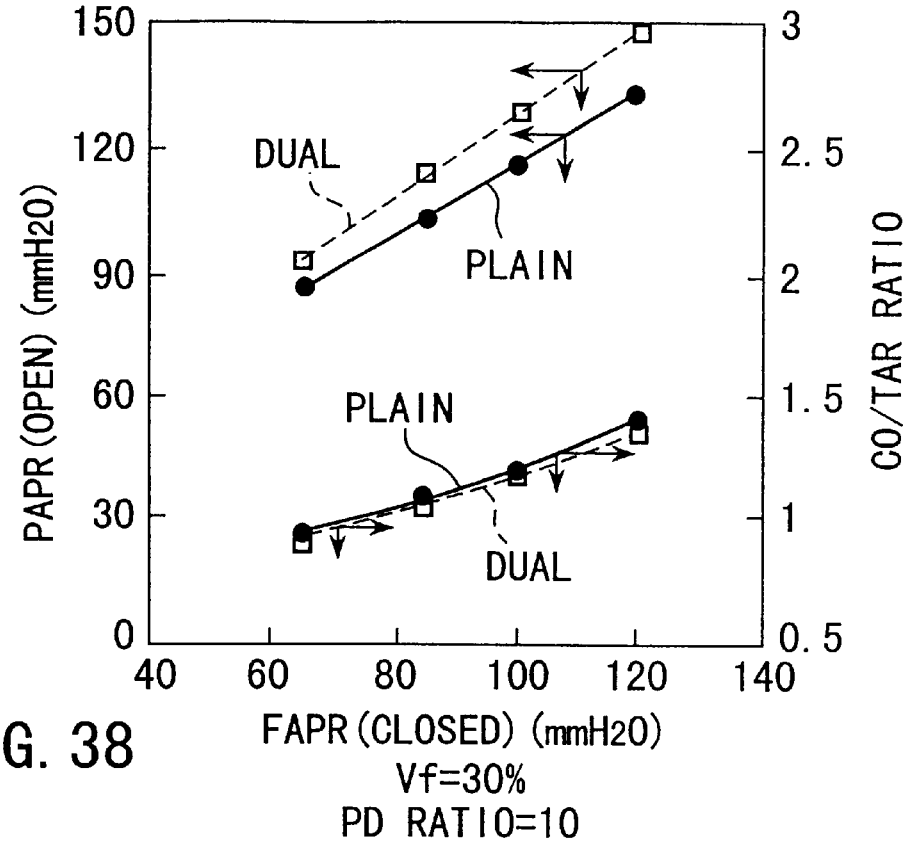
FIG. 38 is a graph showing the product air-permeation resistance and the CO/tar ratio as functions of the filter air-permeation resistance (closed) in a dual-structure filter cigarette (Vf=30%, PD ratio=10) of the present invention.
Figure 39:
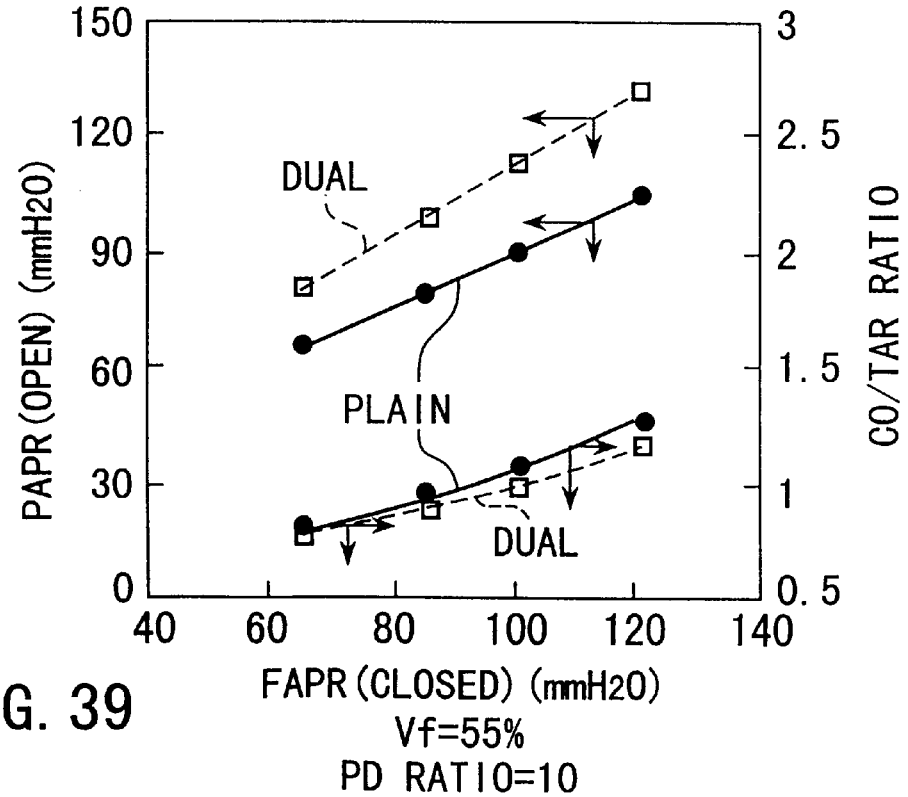
FIG. 39 is a graph showing the product air-permeation resistance and the CO/tar ratio as functions of the filter air-permeation resistance (closed) in a dual-structure filter cigarette (Vf=55%, PD ratio=10) of the present invention.
Figure 40:
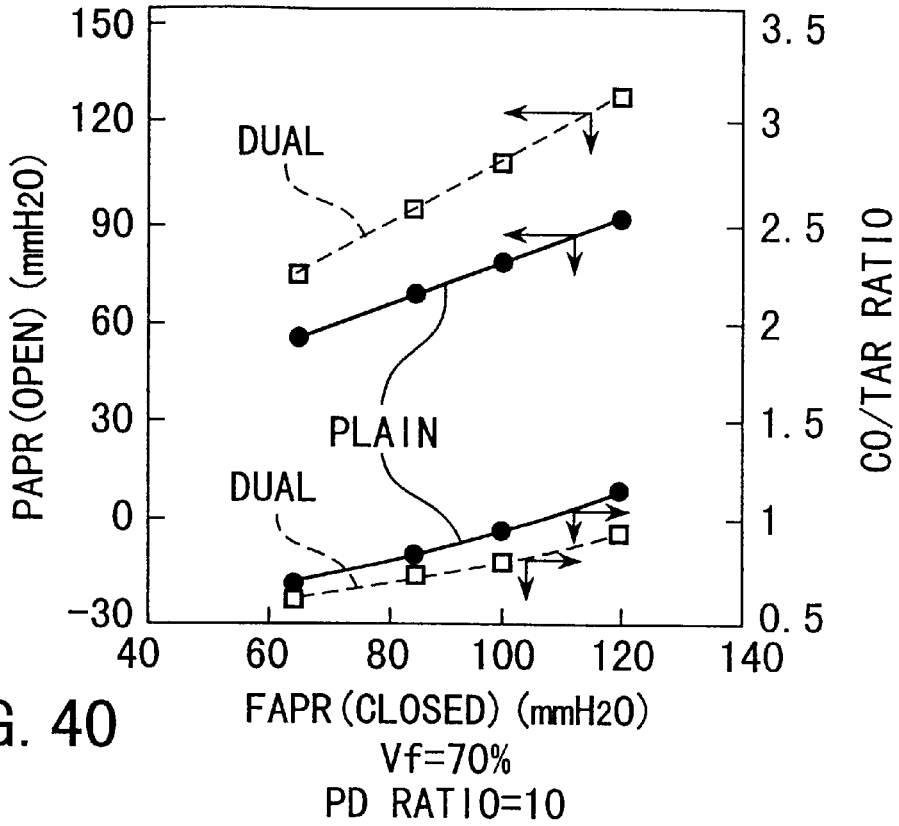
FIG. 40 is a graph showing the product air-permeation resistance and the CO/tar ratio as functions of the filter air-permeation resistance (closed) in a dual-structure filter cigarette (Vf=70%, PD ratio=10) of the present invention.

Furthermore, the PAPR and the CO/tar ratio as functions of the filter air-permeation resistance (closed) when Vf was 30, 55, and 70% in a dual-structure filter having a PD ratio of 10 were checked. The results are shown in FIGS. 38 to 40. In these cases, a filter length was 25 mm, an opening position was 12.5 mm, a PD ratio was 10, a first filter element length was 12.5 mm, a second filter element length was 12.5 mm, a tobacco rod CO/tar ratio was 0.60, and a tobacco rod air-permeation resistance was 47 $mmH_2O$. For comparison, the results of plain filters are also shown.

As shown in FIGS. 38 to 40, the objective conditions could be achieved within the range of the FAPR (closed) shown in Table 8 below for each corresponding Vf.

TABLE 8

| Vf % | Filter Air-Permeation Resistance (Closed) mm $H_2O$ | FIG. |
|---|---|---|
| 30 | 65–77 | 38 |
| 55 | 75–88 | 39 |
| 70 | 82 or more | 40 |

Figure 41:
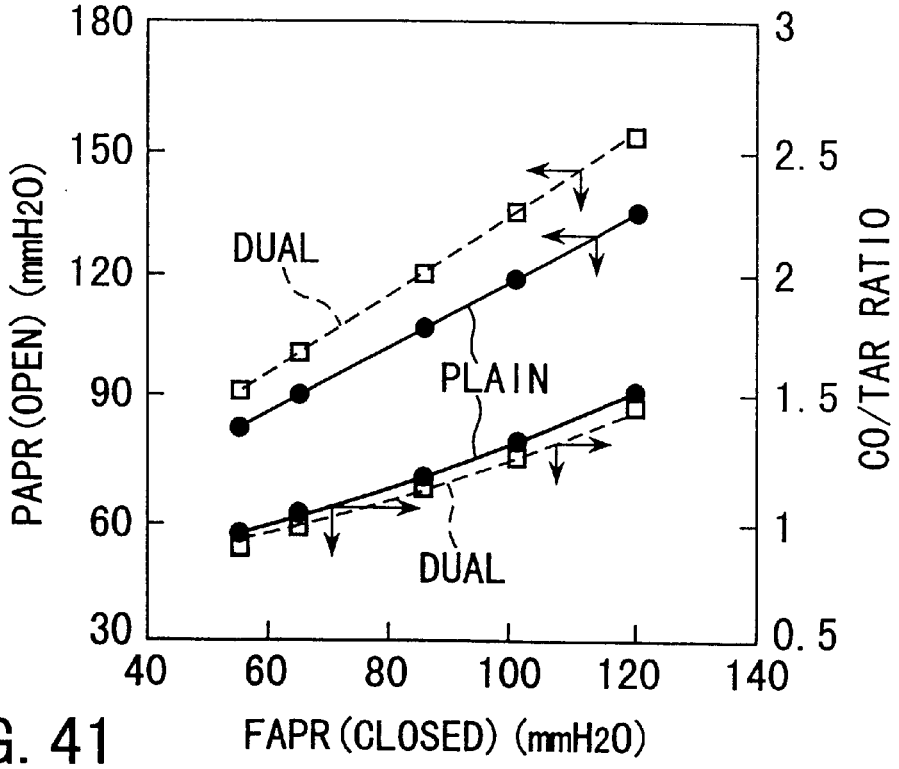
FIG. 41 is a graph showing the product air-permeation resistance and the CO/tar ratio as functions of the filter air-permeation resistance (closed) in a dual-structure filter cigarette (tobacco rod CO/tar ratio=0.67, tobacco rod air-permeation resistance=68 $mmH_2O$, PD ratio=10) of the present invention.
Figure 42:
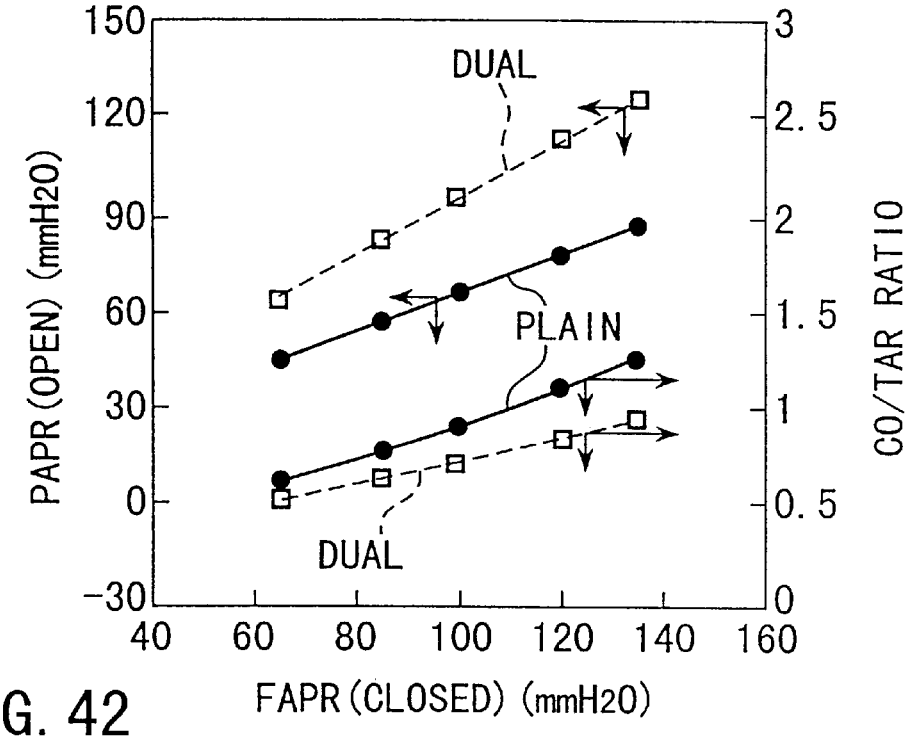
FIG. 42 is a graph showing the product air-permeation resistance and the CO/tar ratio as functions of the filter air-permeation resistance (closed) in a dual-structure filter cigarette (tobacco rod CO/tar ratio=0.80, tobacco rod air-permeation resistance=35 $mmH_2O$, PD ratio=6) of the present invention.

The relationships between the FAPR (closed) and the PAPR when the tobacco rod CO/tar ratio and the tobacco rod air-permeation resistance were changed in cigarettes with dual-structure filters having PD ratios of 10 and 6 were checked. The results are shown in FIGS. 41 and 42. In these cases, a filter length was 25 mm, an opening position was 12.5 mm, a first filter element length was 12.5 mm, and a second filter element length was 12.5 mm. For comparison, the results of a plain filter are also shown.

FIG. 41 corresponds to a cigarette obtained by combining a dual-structure filter having a PD ratio of 10 with a tobacco rod having a tobacco rod CO/tar ratio of 0.67 and a tobacco rod air-permeation resistance of 68 $mmH_2O$, and shows the relationship between the FAPR (closed) and the PAPR when Vf was 40%. As shown in FIG. 41, the objective conditions could be achieved when the FAPR (closed) was 55 to 65 $mmH_2O$.

FIG. 42 corresponds to a cigarette obtained by combining a dual-structure filter having a PD ratio of 6 with a tobacco rod having a tobacco rod CO/tar ratio of 0.80 and a tobacco rod air-permeation resistance of 35 $mmH_2O$, and shows the relationship between the FAPR (closed) and the PAPR when Vf was 80%. As shown in FIG. 42, the objective conditions could be achieved when the FAPR (closed) was 95 to 135 $mmH_2O$.

From the foregoing, when the CO/tar ratio and the air-permeation resistance of a tobacco rod used change, the combination of Vf and the filter air-permeation resistance (closed) by which the objective conditions can be achieved also changes. However, if the CO/tar ratio and the air-permeation resistance of a tobacco rod are 0.8 or less and 35 $mmH_2O$ or more, respectively, the dual-structure filter cigarette of the present invention can achieve the objective conditions.

(v) Length of filter element

Figure 43:
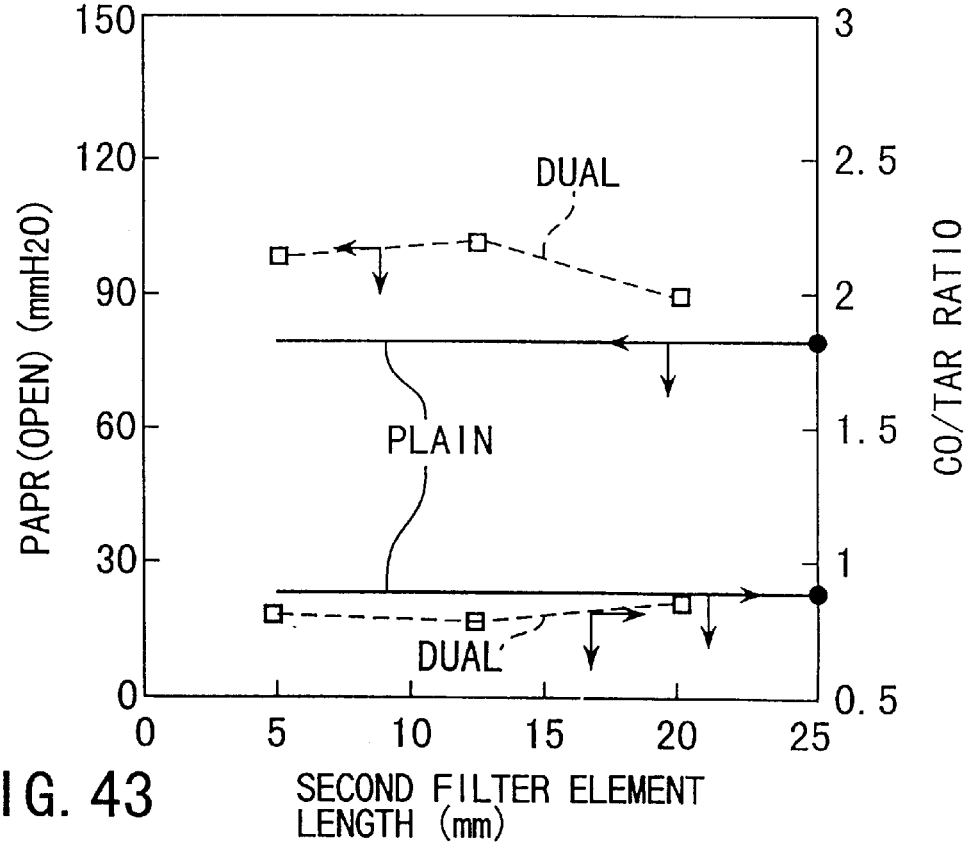
FIG. 43 is a graph showing the CO/tar ratio and the product air-permeation resistance when the filter length was fixed at 25 mm and the length of the second filter element on the downstream side was changed.

The CO/tar ratio and the PAPR were checked while the filter length was fixed at 25 mm and the length of the second filter element on the downstream side was changed. The results are shown in FIG. 43. In this case, a filter length was 25 mm, a FAPR (closed) was 100 $mmH_2O$, Vf was 70%, ZC was 15 mm, and a PD ratio of 6. For comparison, the results of a plain filter are also shown.

As shown in FIG. 43, it was possible to decrease the CO/tar ratio and increase the PAPR compared to the plain filter regardless of the length of the second filter element. Therefore, the ratio of the length of the first filter element to that of the second filter element is not particularly limited. However, it was possible to minimize the CO/tar ratio and maximize the PAPR when the ratio was 1:1, i.e., the lengths were the same.

In the above description, the first and second filter elements constituting the dual filter structure are the ones which are uniform over the entire length and the cross-section. However, these filter elements can also be the other general filter structures such as a channel filter, a double concentric filter, and a constricted filter. That is, the dual-structure filter cigarettes of the present invention can achieve similar effects regardless of the type of filters used in the dual structure.

In summary, the present invention provides a cigarette capable of containing nicotine and tar at reduced concentrations in main stream smoke and at the same time having a high draw resistance without using any special material or structure. Secondly, the present invention provides a cigarette meeting requirements that are generally incompatible with each other, i.e., having a CO/tar ratio of less than 1 and also having a satisfactory product air-permeation resistance.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A cigarette with a dual-structure filter, comprising:

a dual-structure filter having a first filter element and a second filter element arranged downstream of said first filter element, said first filter element and said second filter element each filter element comprising a cellulose acetate fiber tow;

a tobacco rod arranged upstream of said filter; and a tip paper covering a downstream end portion of said tobacco rod and a substantially entire circumferential surface of said filter and having air inflow means comprising at least one row of a plurality of holes formed in a circumferential direction of said filter, wherein an air-permeation resistance per unit length of said first filter element is 1 to 4 $mmH_2O/mm$, an air-permeation resistance per unit length of said second filter element is 2 to 7 times an air-permeation resistance per unit length of said first filter element, wherein said air inflow means is formed at an area of said tip paper which corresponds to said first filter element and has an opening position in a range of 4 mm from an upstream end to 14 mm from a downstream end of said an air inflow ratio from said tip paper is not less than 20%.

2. The cigarette according to claim 1, wherein the air inflow rate is not less than 35%.

3. The cigarette according to claim 1, wherein the air inflow rate from said tip paper is 60 to 85%.

4. The cigarette according to claim 1, wherein said air inflow means has an opening position in a region corresponding to said first filter element.

5. A cigarette according to claim 4, wherein said air inflow means has an opening position in a range of 4 mm from an upstream end to 14 mm from a downstream end of said filter.

6. The cigarette according to claim 5, wherein said filter has a length of 19 to 40 mm, and a circumferential length of 20 to 27 mm.

7. The cigarette according to claim 1, wherein the air-permeation resistance per unit length of said second filter element is 3 to 7 times the air-permeation resistance per unit length of said first filter element.

8. The cigarette according to claim 1, wherein the air inflow rate from said tip paper is 30 to 85%.

9. The cigarette according to claim 1, wherein said filter has a length of 15 to 40 mm, and a circumferential length of 20 to 27 mm.

10. The cigarette according to claim 1, wherein said cigarette exhibits a CO/tar ratio of less than 1.

11. The cigarette according to claim 1, wherein said first filter element is 10 mm in length and said second filter element is 15 mm in length.

12. The cigarette according to claim 1, wherein said first filter element comprises cellulose acetate tows having a total tow weight of 144/300 Denier and said second filter element comprises cellulose acetate tows having a total tow weight of 2.24/4000 Denier.

13. The cigarette according to claim 1, wherein said first filter element comprises cellulose acetate tows having a total tow weight of 1.54/4400 Denier and said second filter element comprises cellulose acetate tows having a total tow weight of 34/3600 Denier.

14. The cigarette according to claim 1, wherein said first filter element comprises cellulose acetate tows having a total tow weight of 44/4000 Denier and said second filter element comprises cellulose acetate tows having a total tow weight of 1.54/44000 Denier.

15. The cigarette according to claim 1, wherein said first filter element comprises cellulose acetate tows having a total tow weight of 144/3000 Denier and said second filter element compries cellulose acetate tows having a total tow weight of 1.54/44000 Denier.

16. A cigarette with a dual-structure filter, comprising:

a dual-structure filter having a first filter element and a second filter element arranged downstream of said first filter element, said first filter element and said second filter element each filter element comprising a cellulose acetate fiber tow;

a tobacco rod arranged upstream of said filter; and a tip paper covering a downstream end portion of said tobacco rod and a circumferential surface of said filter and having an air flowing means including at least one row of a plurality of holes formed in a circumferential direction of said filter, wherein an air-permeation resistance per unit length of said first filter element is 1 to 4 $mmH_2O/mm$, an air-permeation resistance per unit length of said second filter element is 2.5 to 10 times an air-permeation resistance per unit length of said first filter element, an air inflow ratio from said tip paper is 20 to 85%, said air flowing means is formed at an area of said tip paper which corresponds to said first filter element, and has an opening position in a range of 4 mm from an upstream end to 14 mm from a downstream end of said filter, a CO/tar ration is less than 1, and a product air-permeation resistance is 90 to 130 $mmH_2O$.

17. The cigarette according to claim 16, wherein the air-permeation resistance per unit length of said second filter element is 3 to 7 times the air-permeation resistance per unit length of said first filter element.

18. The cigarette according to claim 16, wherein the air low rate from said tip paper is 20 to 85%.

19. The cigarette according to claim 16, wherein said filter a length of 15 to 40 mm, and a circumferential length of 20 to 27 mm.

20. The cigarette according to claim 1, wherein said first filter element is added with activated carbon.

21. The cigarette according to claim 16, wherein said first filter element is added with activated carbon.

22. The cigarette according to claim 1, wherein said first or second filter element is covered with a wrapper having an air-permeability of 1000 to 50000 $mL/cm^2/min/100$ mmH2O.

23. The cigarette according to claim 1, wherein said first and second filter elements are covered with wrappers having an air-permeability of 1000 to 5000$mL/cm^2/min/100$ $mm\text{-}H_2O$, respectively.

24. The cigarette according to claim 16, wherein said first or second filter element is covered with a wrapper having an air-permeability of 1000 to 50000 $mL/cm^2/min/100$ $mm\text{-}H_2O$.

25. The cigarette according to claim 16, wherein said first and second filter elements are covered with wrappers having an air-permeability of 1000 to 50000 $mL/cm^2/min/100$ $mm\text{-}H_2O$, respectively.

* * * * *